US009167892B1

(12) United States Patent
Korb

(10) Patent No.: US 9,167,892 B1
(45) Date of Patent: Oct. 27, 2015

(54) OFFSET FOLDING LEG ASSEMBLY

(71) Applicant: DSA INTERNATIONAL, INC., Zeeland, MI (US)

(72) Inventor: Daniel Korb, Baden (CH)

(73) Assignee: DSA International, Inc., Zeeland, MI (US)

( * ) Notice: Subject to any disclaimer, the term of this patent is extended or adjusted under 35 U.S.C. 154(b) by 0 days.

(21) Appl. No.: 14/259,500

(22) Filed: Apr. 23, 2014

(51) Int. Cl.
*A47B 3/00* (2006.01)
*A47B 3/08* (2006.01)

(52) U.S. Cl.
CPC ..... *A47B 3/08* (2013.01)

(58) Field of Classification Search
CPC ..... A47B 2003/0821; A47B 2003/0824; A47B 2003/0827; A47B 2003/0815; A47B 2003/0812; A47B 3/08; A47B 3/0815; A47B 3/0812
USPC ..... 108/131, 130, 132, 129; 248/188.1, 248/188.6
See application file for complete search history.

(56) References Cited

U.S. PATENT DOCUMENTS

| | | | | |
|---|---|---|---|---|
| 166,263 | A | 8/1875 | Crawford | |
| 519,379 | A | 5/1894 | Chormann | |
| 2,697,018 | A | 12/1954 | Zanos | |
| 3,419,295 | A * | 12/1968 | Small | 403/92 |
| 4,064,815 | A | 12/1977 | Baum | |
| 4,383,486 | A * | 5/1983 | Reineman et al. | 108/2 |
| 4,494,465 | A * | 1/1985 | Fick, Jr. | 108/131 |
| 4,747,569 | A * | 5/1988 | Hoshino | 248/291.1 |
| 5,265,969 | A * | 11/1993 | Chuang | 403/94 |
| 5,520,474 | A * | 5/1996 | Liu | 403/97 |
| 6,044,775 | A | 4/2000 | Lashlee | |
| 6,598,544 | B2 | 7/2003 | Laws | |
| 7,107,915 | B2 | 9/2006 | Laws | |
| 7,478,602 | B2 * | 1/2009 | Peng | 108/131 |
| 7,658,388 | B1 * | 2/2010 | Rodriguez et al. | 108/131 |
| 7,942,101 | B2 * | 5/2011 | Conley | 108/129 |
| 8,413,593 | B2 * | 4/2013 | Korb | 108/115 |
| 2010/0175598 | A1 | 7/2010 | Ballendat | |

FOREIGN PATENT DOCUMENTS

| | | | |
|---|---|---|---|
| DE | 202006016469 | U1 | 1/2007 |
| DE | 102007033742 | B3 | 12/2009 |
| FR | 2146660 | | 2/1973 |
| JP | 2004073326 | | 3/2004 |
| WO | 03068020 | A1 | 8/2003 |

* cited by examiner

*Primary Examiner* — Jose V Chen
(74) *Attorney, Agent, or Firm* — Niro McAndrews, LLC

(57) ABSTRACT

Disclosed is an intuitively operable rotation mechanism for a flip top table that includes an offsetting feature that provides aligned table legs when the table is in a use configuration while offsetting the legs when they are in a storage configuration. By offsetting the table legs in storage configuration, the height of the table legs can be more than one half of the length of the table. This feature is of particular importance for folding tables that are positioned at a standing height.

17 Claims, 27 Drawing Sheets

OFFSET FOLDING LEG ASSEMBLY

FIELD OF THE INVENTION

The present invention relates generally to a folding leg mechanism, and more particularly to a folding leg mechanism that offsets the folded table legs when in a storage configuration while aligning the legs when in a use configuration.

BACKGROUND OF THE INVENTION

Folding tables are commonly used in commercial and residential settings where tables are intermittently needed, or the tables need to be moved on a regular basis. Tables in a storage configuration take up less space and are often stackable on other folded tables, thus reducing the amount of storage space needed. Latching mechanisms have been used to lock the table legs in either a storage or use configuration, however these mechanisms often do not provide sufficient rigidity and may cause the table to wobble. Additionally, latching mechanisms often involve numerous small interconnected pieces that may jam due to the buildup of dirt and debris, or be damaged when the tables are transported or stored.

SUMMARY OF THE INVENTION

The present invention provides an improved latching mechanism for tables with foldable legs. While maintaining the benefits of standard mechanisms, the mechanism of the present invention also achieves many benefits including an intuitively operable release mechanism and an offsetting mechanism that provides aligned table legs when the table is in a use configuration and offset table legs when in a storage configuration. By offsetting the table legs in storage configuration, the height of the table legs can be more than one half of the length of the table. This feature is of particular importance for folding tables that are utilized by standing persons.

DETAILED DESCRIPTION

The present invention may be used with any type of leg and any type of top surface and is particularly suited for tables and applications requiring a lightweight, rigid, and robust mechanism with an intuitively operated release action. The improved folding mechanism may be used with objects having folding legs such as chairs and tables, stadium seating or benches. However, for descriptive purposes, the present invention will be described in use with a table.

Figure 1:
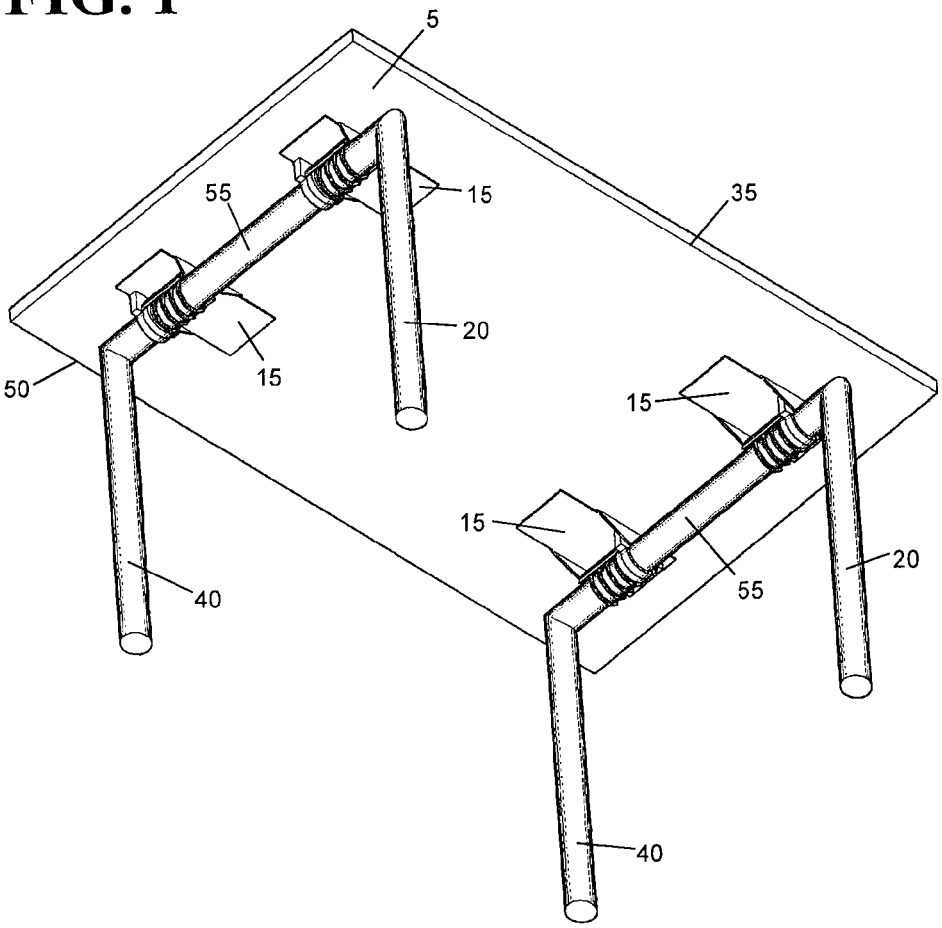
FIG. 1 is a lower perspective view of a table with legs in a use configuration.
Figure 2:
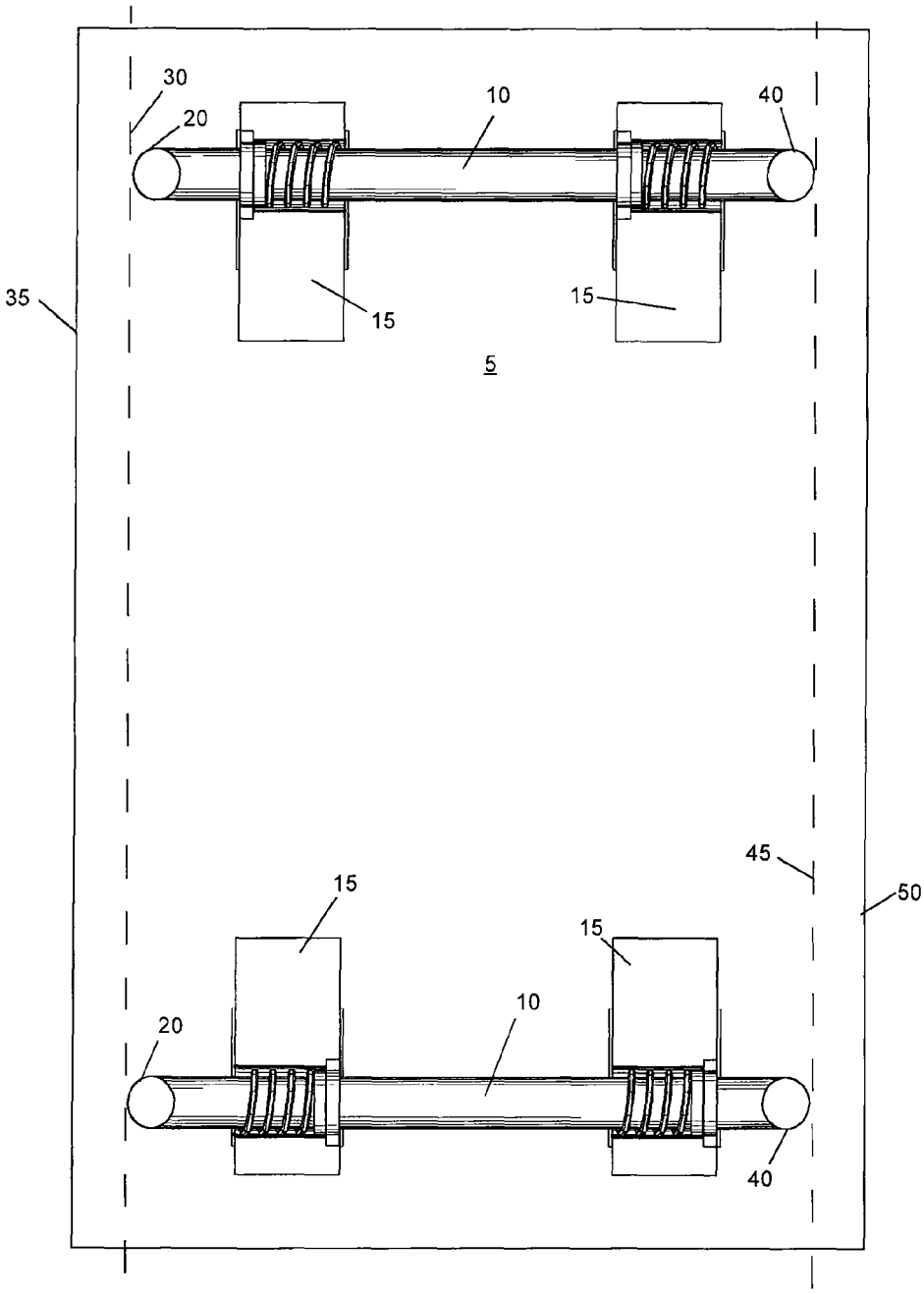
FIG. 2 is a bottom view of a table with legs in a use configuration.
Figure 3:
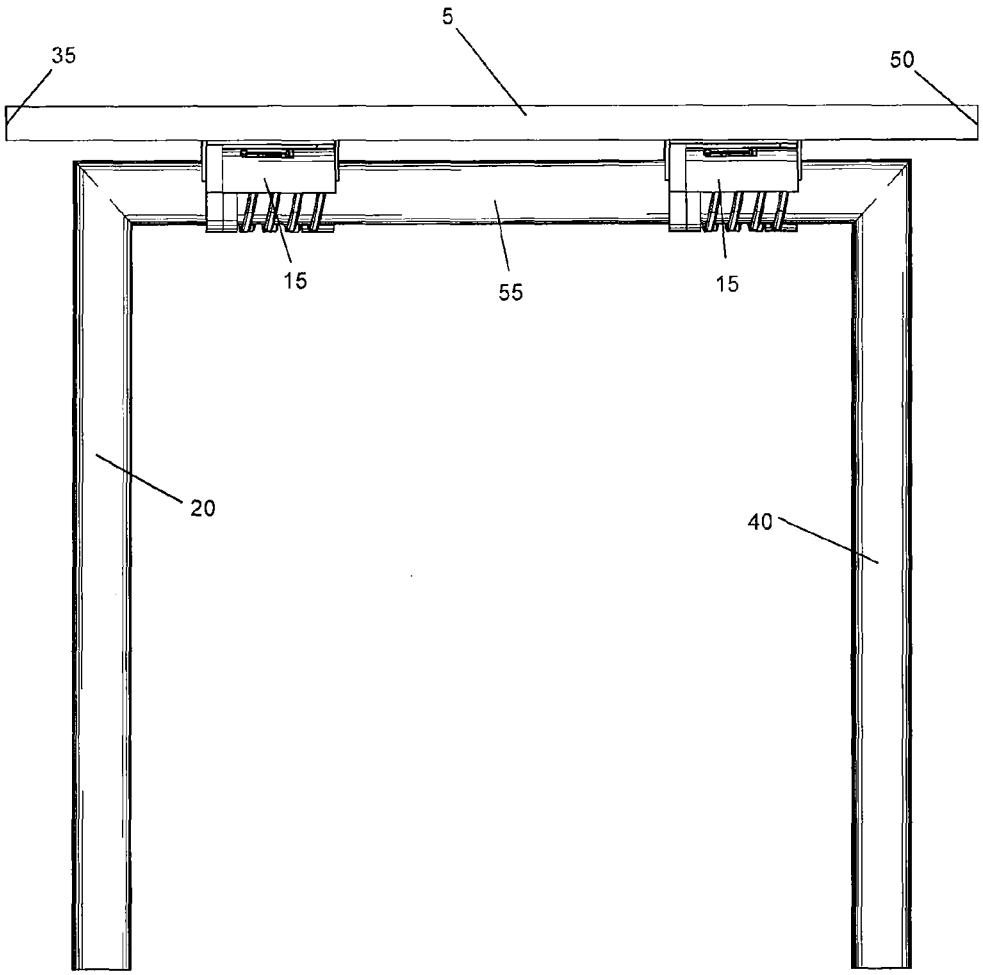
FIG. 3 is a side view of a table with legs in a use configuration.

FIGS. 1-3 show views of a table top 5 secured to table legs 10 via rotation mechanisms 15. The first vertical portions 20 of the distinct table legs are aligned along a geometric plane 30 and are equidistant from a linear horizontal edge 35 of the table top when the table legs 10 are in a use configuration. While not required, the illustrated table system is symmetrical such that each table leg 10 has a second vertical portion 40 that is aligned along another geometric plane 45 and the second vertical portions 40 located near, and equidistant from a second edge 50 of the table top 5. The first vertical portion 20 of the table leg 10 is separated from the second vertical portion 40 by a horizontal portion 55 that passes through the rotation mechanisms 15.

Figure 4:
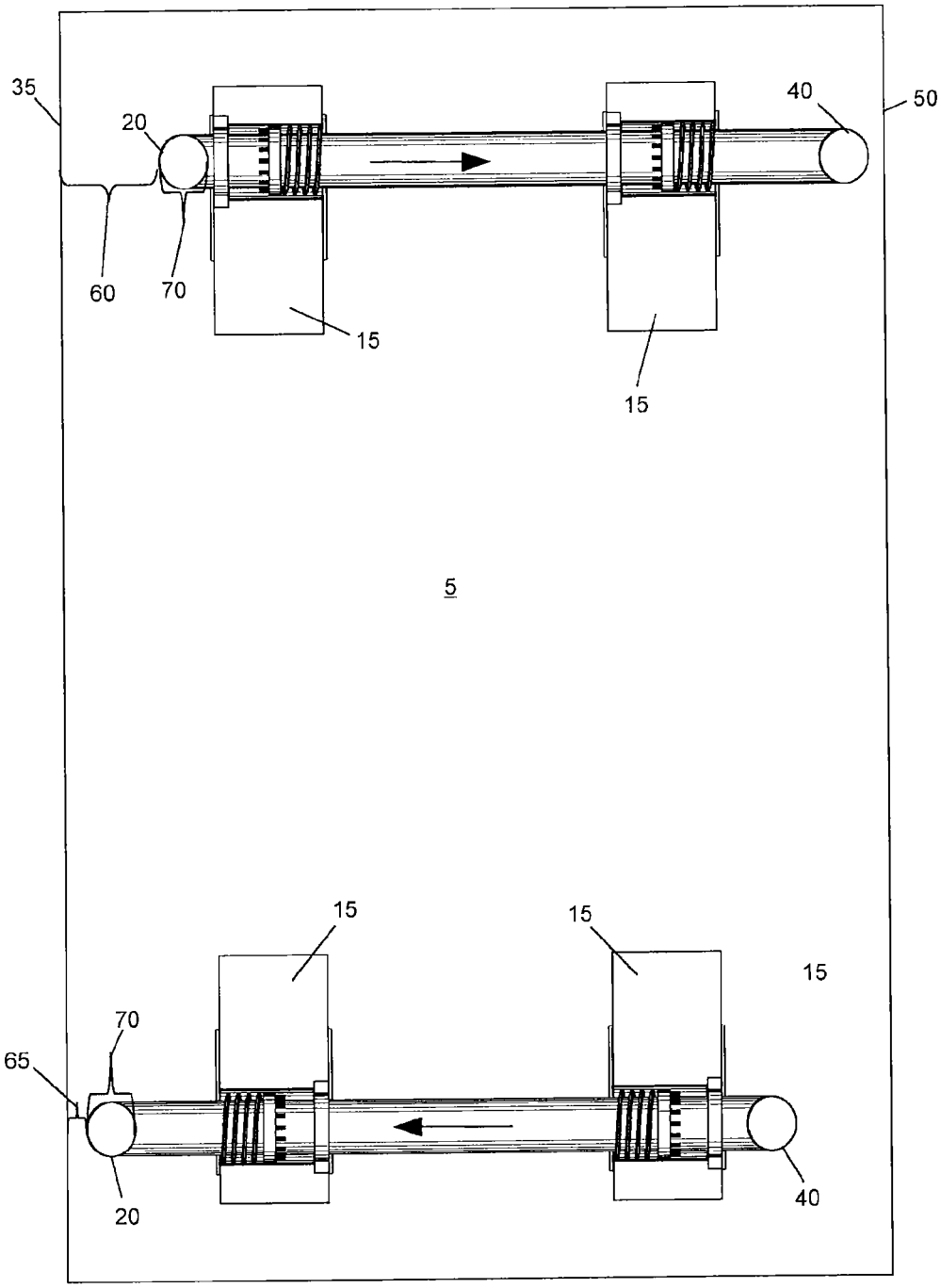
FIG. 4 is a bottom view of a table with legs that have been moved to an offset position, but not a storage position.
Figure 5:
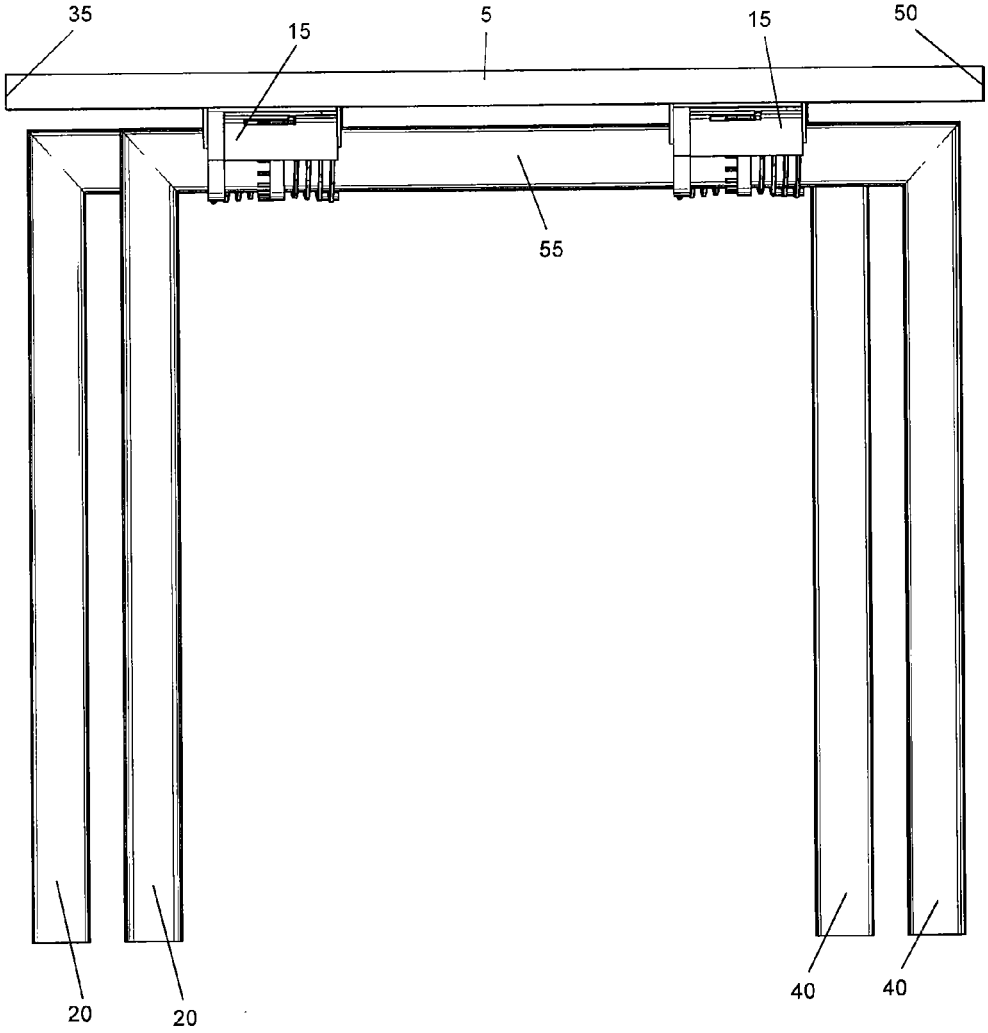
FIG. 5 is a side view of a table with legs that have been moved to an offset position, but not a storage position.

In FIGS. 4 and 5, the two table legs have been slid through the rotation mechanisms 15 such that the first vertical portion 20 of one leg is substantially further away (a first distance 60) from the edge 35 than the first vertical portion 20 of the other leg (a second distance 65). The first distance 60 is substantially greater than the second distance 65 in that the difference between the two distances produces a significant chance in the position of the circular collar and protrusion along the axis of rotation of the table leg. The difference between the first distance 60 and the second distance 65 is greater than the width 70 of the first vertical portion 20 to facilitate the legs over lapping upon each other.

Figure 6:
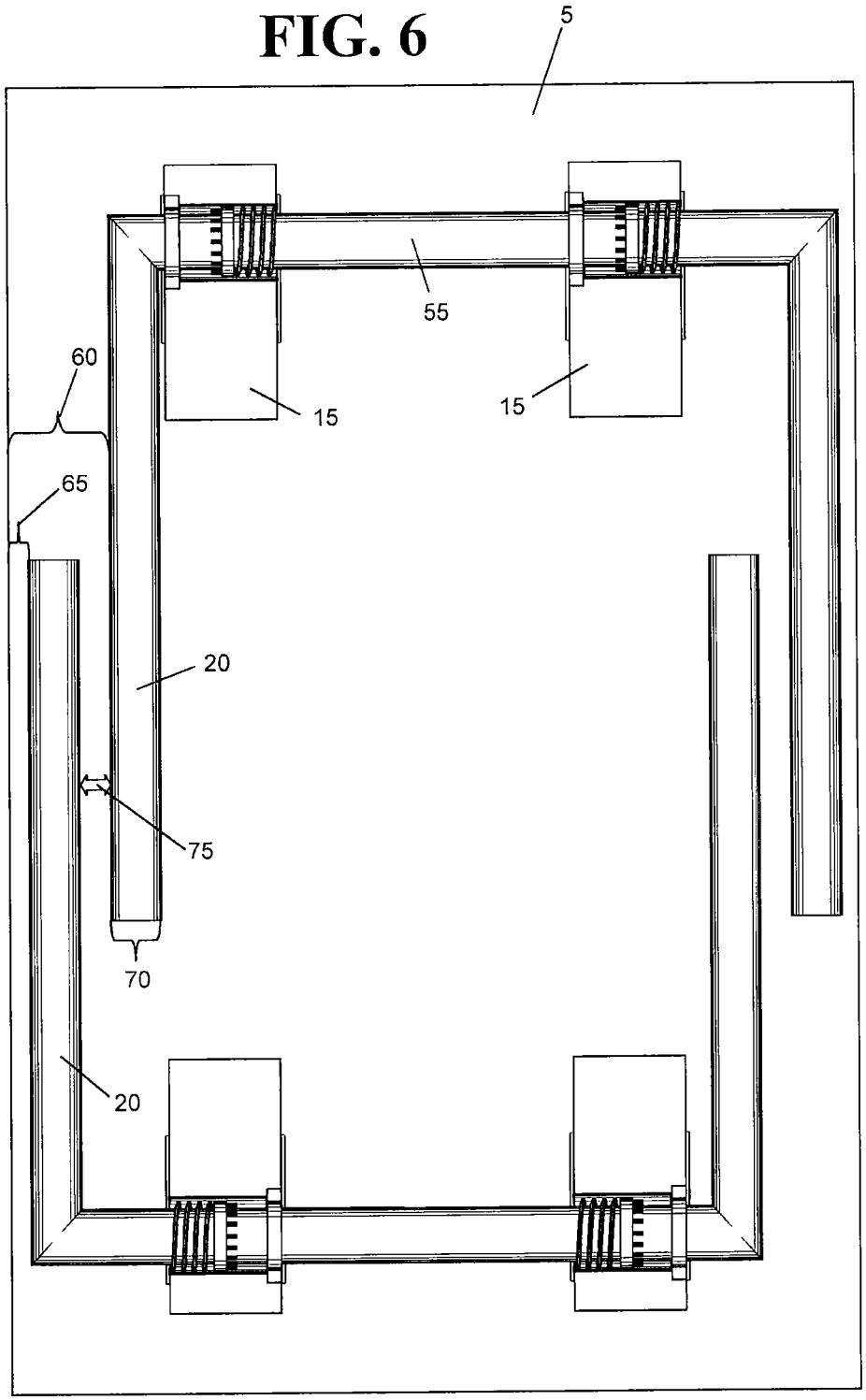
FIG. 6 is a bottom view of a table with legs that have been moved to an offset storage position, but have not been secured in the storage position.
Figure 7:
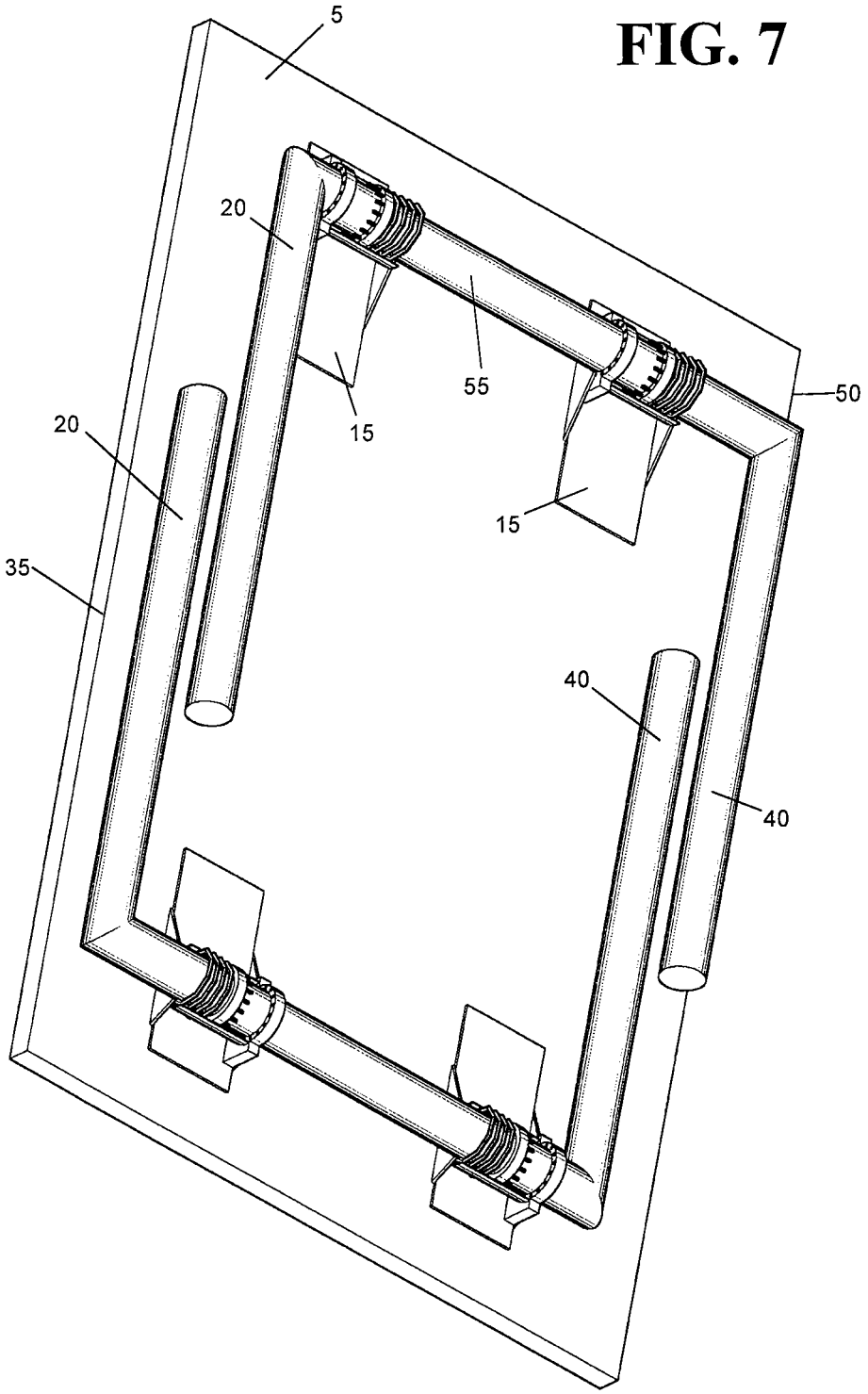
FIG. 7 is a bottom perspective view of a table with legs that have been moved to an offset storage position, but have not been secured in the storage position.

FIGS. 6 and 7 show the table legs of FIGS. 4 and 5 having been rotated such that the vertical portions (20 and 40) of the table legs 10 are located adjacent to the table top 5. The table legs 10 in FIGS. 6 and 7 are not secured in a storage configuration and the two first vertical portions 20 of the table legs are separated from the linear horizontal edge 35 by the first distance 60 and the second distance 65, respectively. Since the differences of the first distance 60 and the second distance 65 is greater than the width 70 of the first vertical portion 20, there is a slight gap 75 between the two first vertical portions 20.

Figure 8:
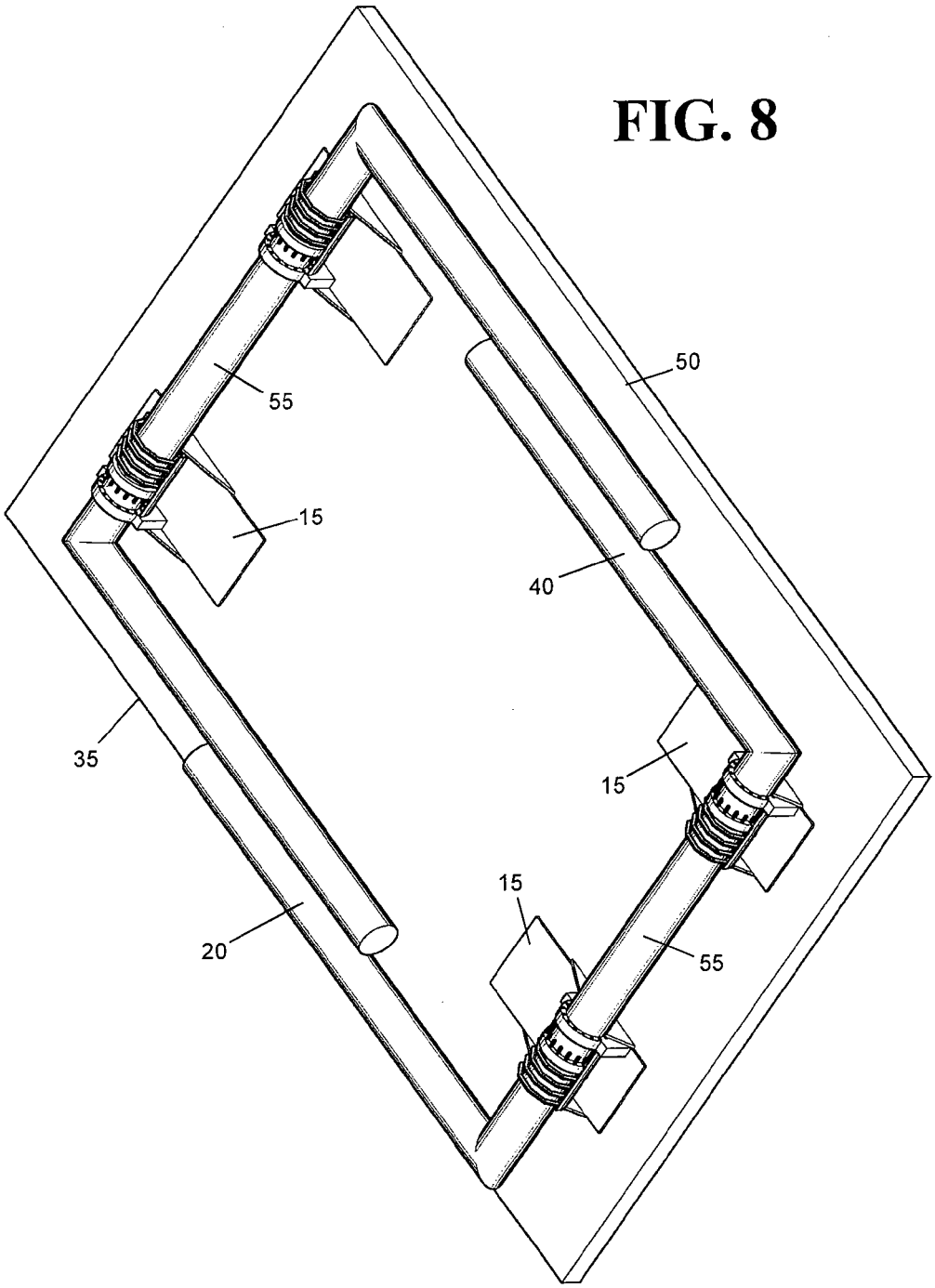
FIG. 8 is a bottom perspective view of a table with legs that have been secured in an offset storage position.
Figure 9:
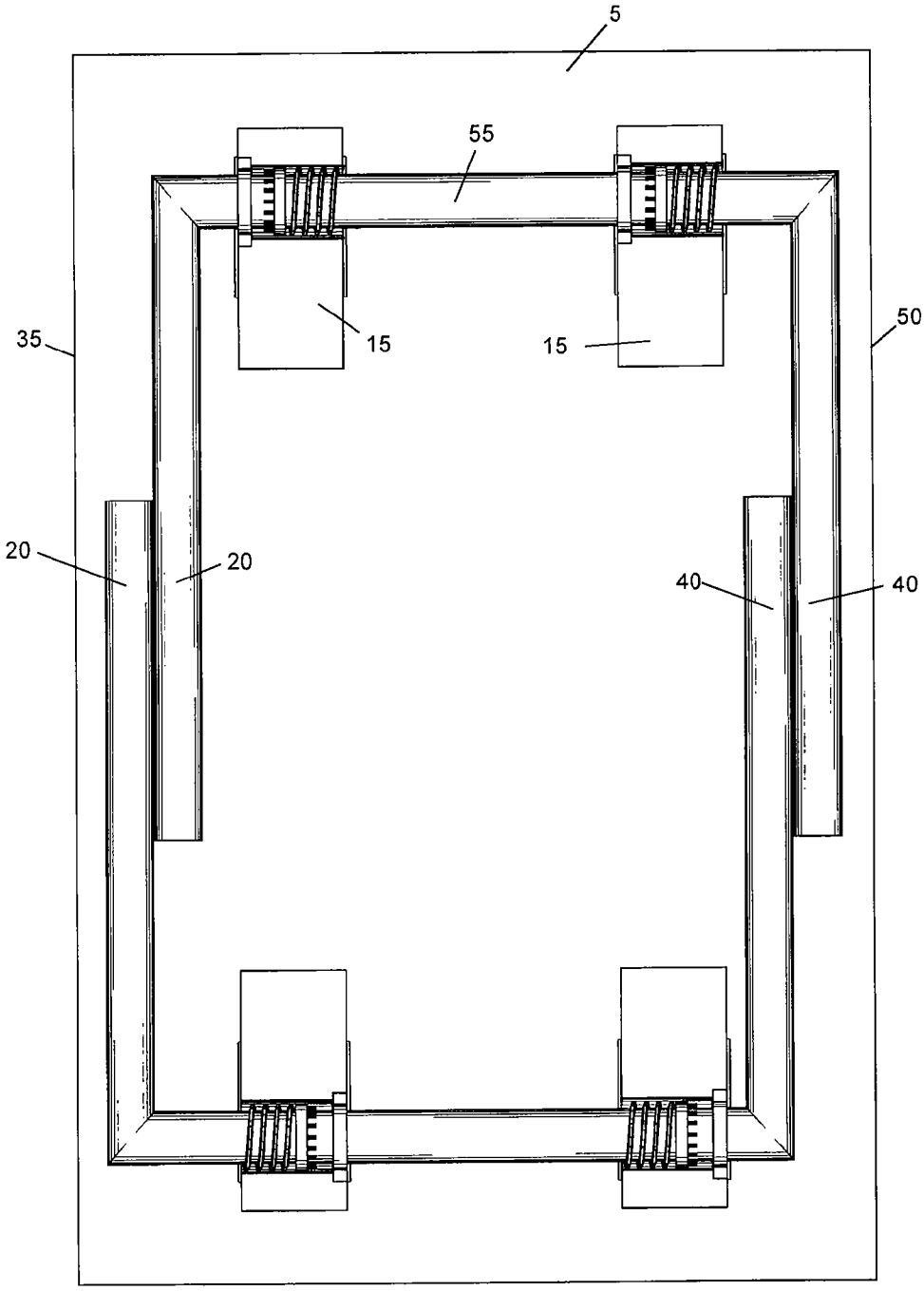
FIG. 9 is a bottom view of a table with legs that have been secured in an offset storage position.
Figure 10:
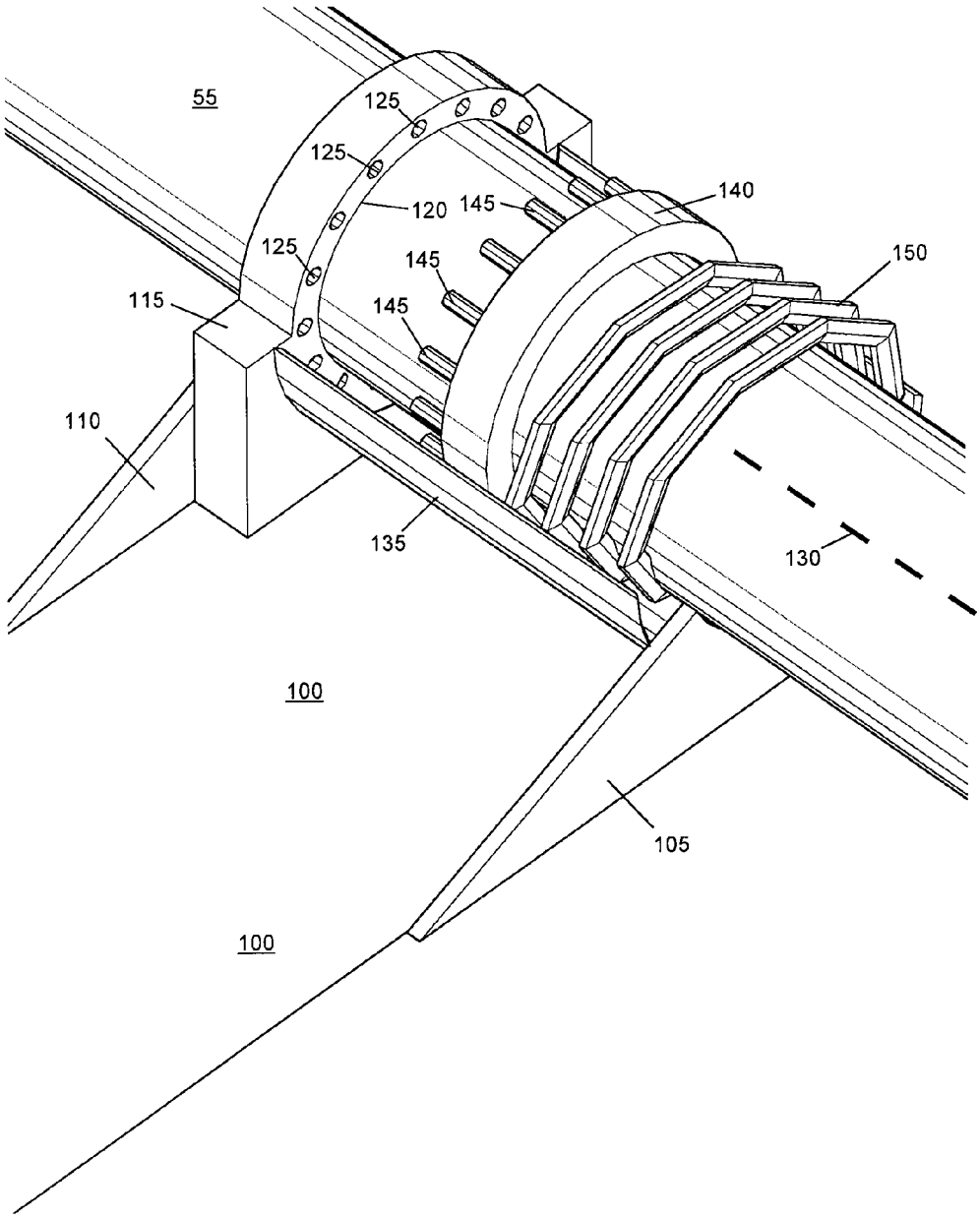
FIG. 10 is a perspective view of a folding mechanism with a leg between a use and storage configuration.
Figure 11:
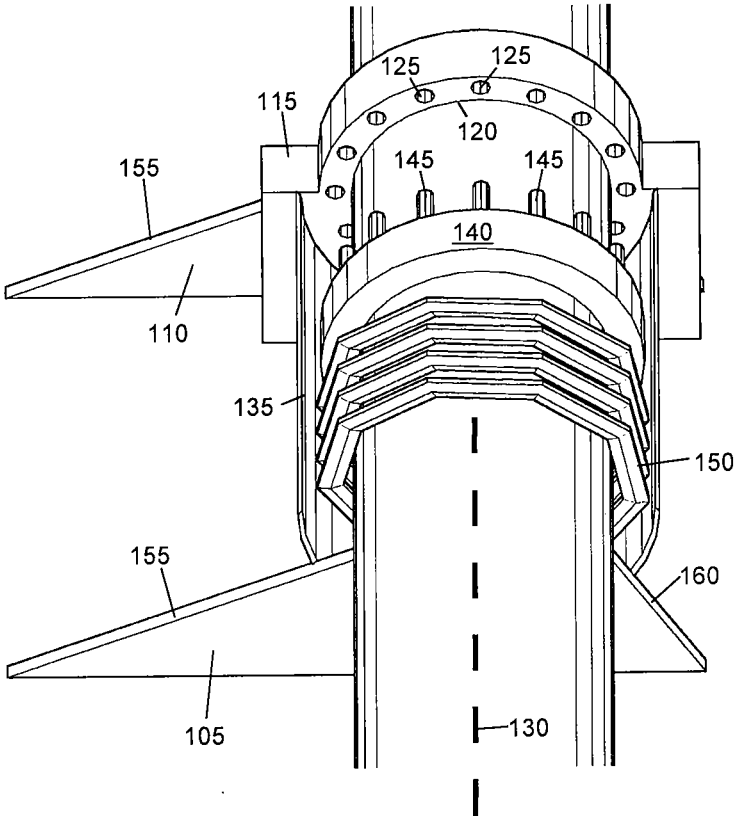
FIG. 11 is a side perspective view of a folding mechanism with a leg between a use and storage configuration.
Figure 12:
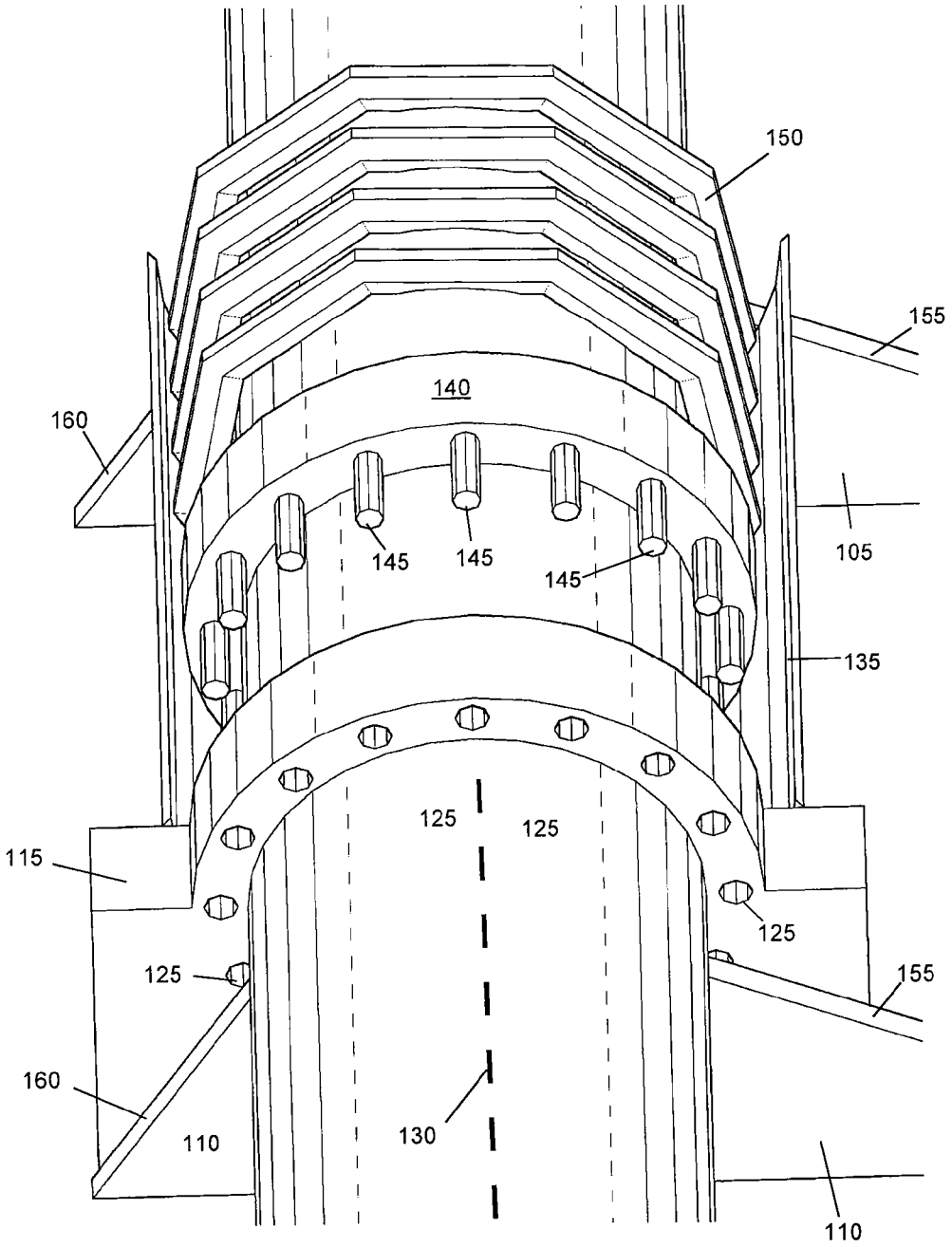
FIG. 12 is a second perspective view of a folding mechanism with a leg between a use and storage configuration.
Figure 13:
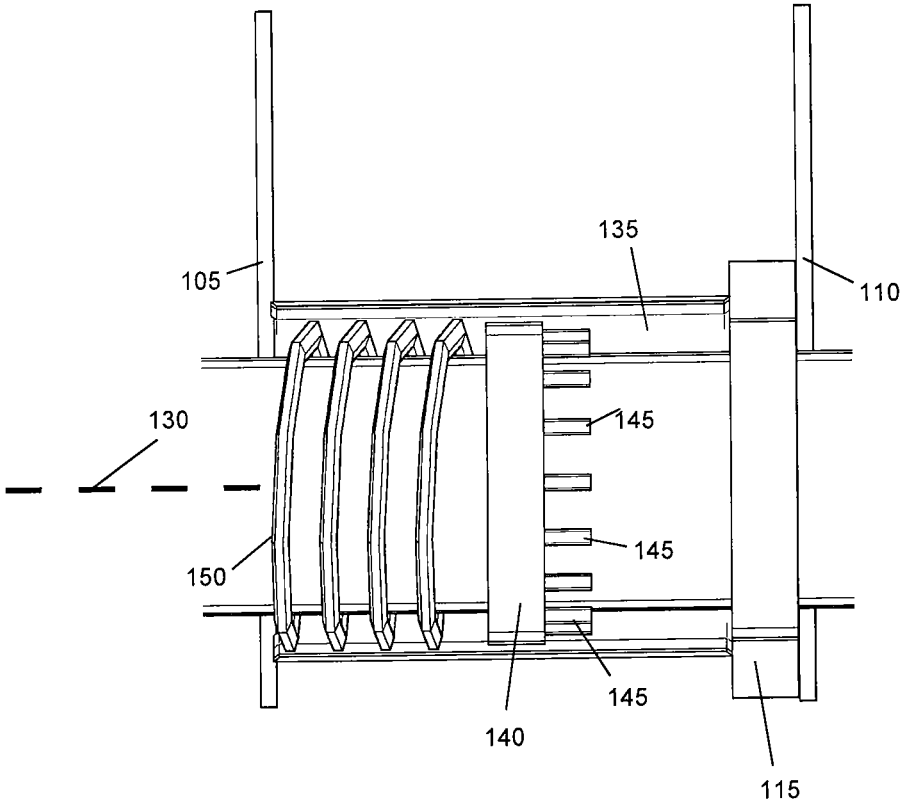
FIG. 13 is a bottom view of a folding mechanism with a leg between a use and storage configuration.
Figure 14:
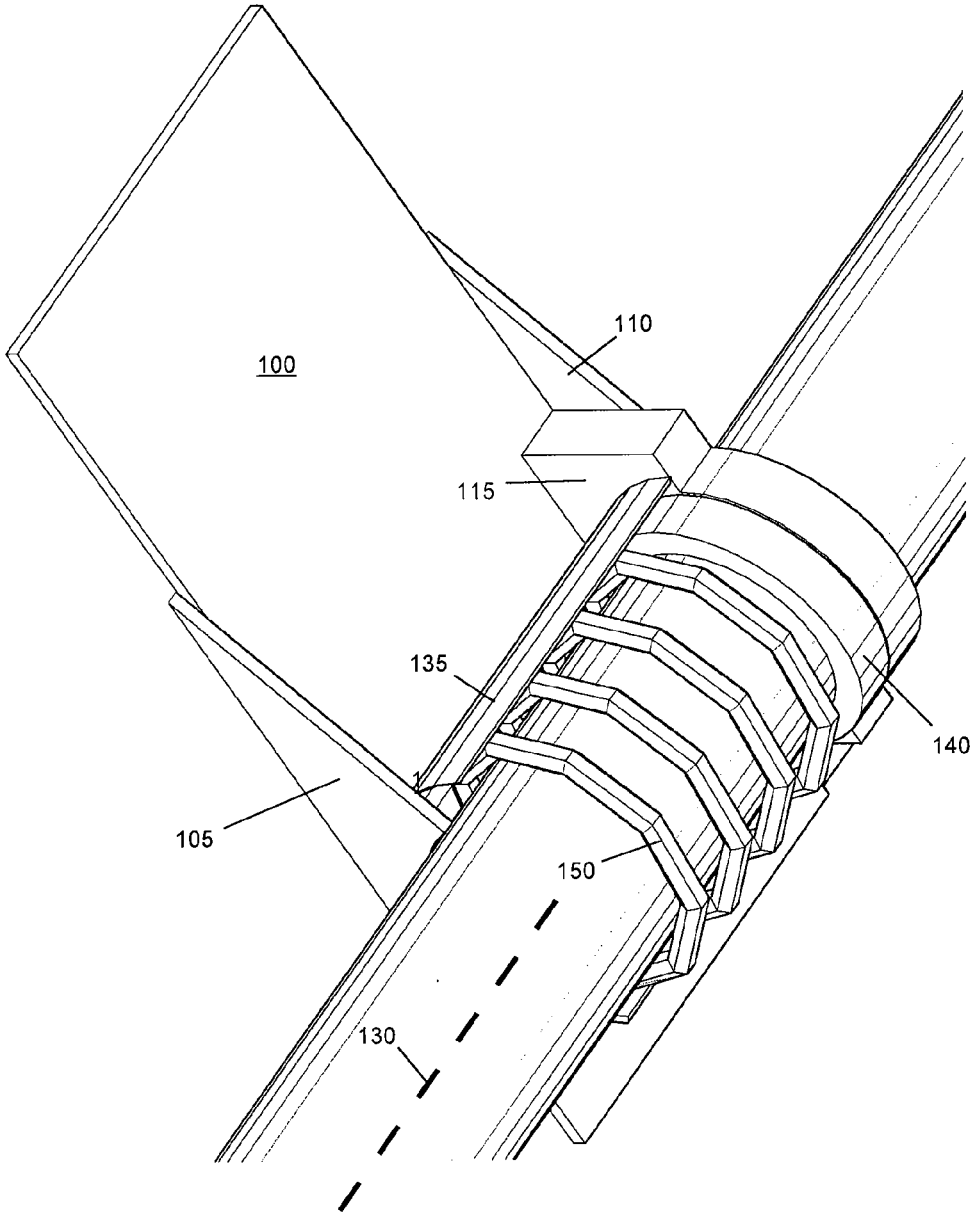
FIG. 14 is a bottom perspective view of a folding mechanism secured in a use configuration.
Figure 15:
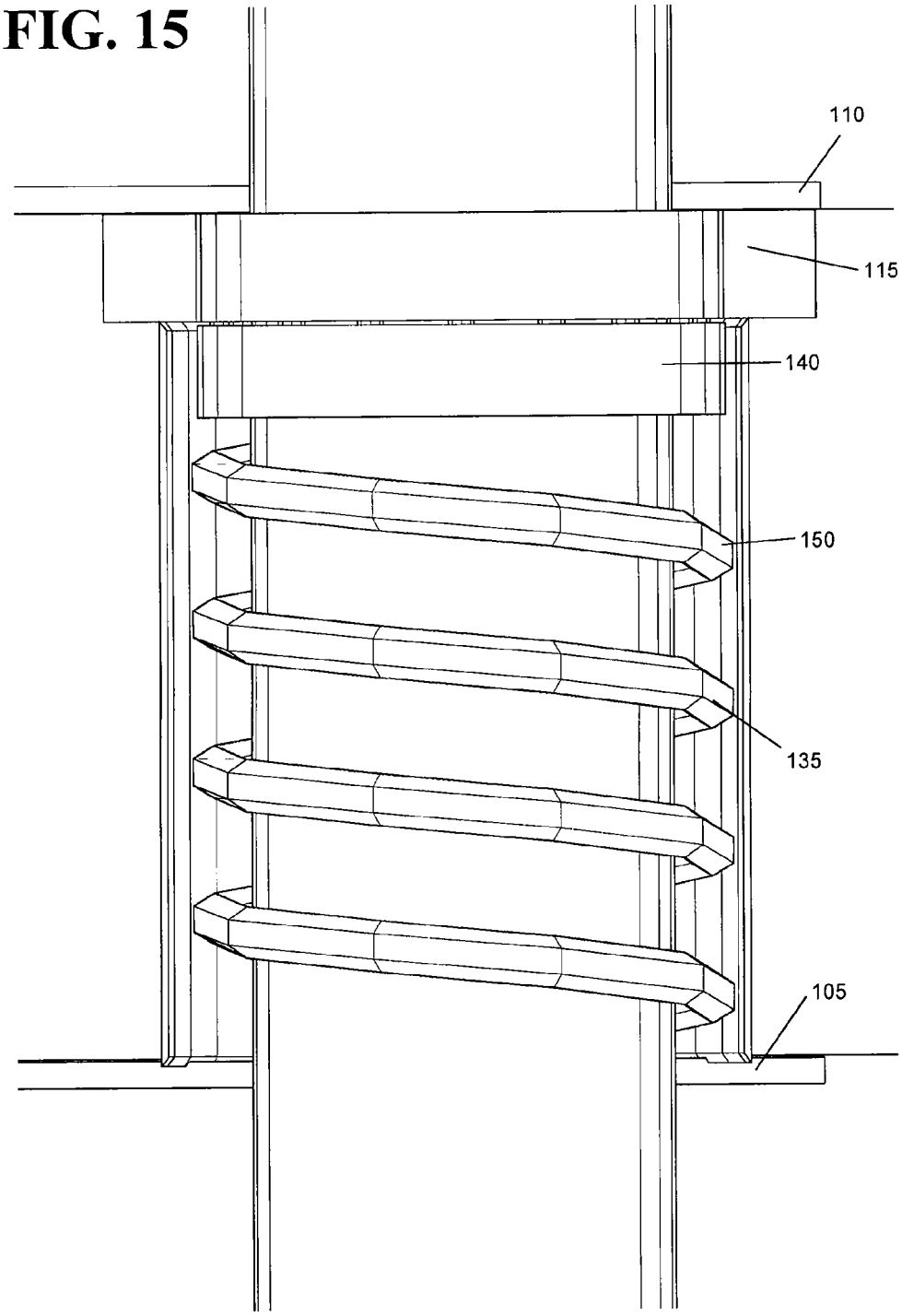
FIG. 15 is a bottom view of a folding mechanism secured in a use configuration.

FIGS. 8 and 9 show the tables of FIGS. 4-7 in a folded and secured position. The first vertical portions 20 of the two table legs 10 have moved closer to each other such that the gap shown in FIGS. 6 and 7 between the table legs has been removed or substantially reduced. The movement of the table legs towards each other causes features in the rotation mechanisms 15 to secure the table legs in the storage position. To disengage the table legs from the storage position or configuration, the legs are moved away from each other to disengage the locking features in the rotation mechanisms.

FIGS. 10 through 13 show an isolated view of the rotation mechanism 15 interacting with a table leg 10. The rotation mechanism includes a base 100 or plate adapted to be secured to the table top. In the illustrated example, the base 100 has a substantially rectangular shape, however it should be appreciated that other shapes such as circular or polygonal may be utilized. The base 100 may include holes or openings through which fasteners (such as screws) pass through and interconnect with the table top. Flanking the base 100, and extending away from the table top, are a first sidewall 105 and a second sidewall 110. A locking ring 115 or locking wall also extends downward away from the table top and is rigidly secured to the base 100. The locking ring 115 includes a circular aperture 120 through which the horizontal portion 55 of the table leg 10 slides. The circular aperture 120 is substantially defined by the circumference of the horizontal portion 55 of the table leg and allows the table leg 10 to both slide through the circular aperture 120 and rotate within the aperture. Surrounding the circular aperture 120 are a plurality of openings 125 that extend through the locking ring 115. As with the circular aperture 120, the openings 125 extend through the locking ring 115 parallel to the axis of rotation 130 of the table leg. As shown in the figures, the openings 125 are substantially smaller than the circular aperture 120. While the openings 125 are shown as circular, it should be appreciated that the openings 125 may be a variety of shapes. Between the locking ring 115 (locking wall) and the first sidewall 105 is a cylindrical sheet 135 or cylindrical piece partially circumscribing the horizontal portion 55 of the table leg, and located between the horizontal portion 55 and the base 100 of the rotation mechanism 15. The cylindrical sheet 135 is substantially concentric with the horizontal portion 55 such that there is a substantially constant separation between the cylindrical sheet 135 and the horizontal portion 55. At the rotation mechanism 15, the table leg 10 includes a circular collar 140 with a diameter greater than the circular aperture 120. While the diameter of the circular collar 140 is greater than that of the circular aperture 120, the circular collar 140 has a smaller radius of curvature than the cylindrical sheet 135. From the circular collar 140, a plurality of pins 145 extend, parallel to the axis of rotation 130, towards the locking ring 115. The pins 145 have shapes that are substantially defined by the shape of the openings 125, and are slightly smaller than the openings such that they are able to be secured within the openings 125 when the table legs are in a use configuration. In one embodiment, the ends of the pins are slightly tapered to facilitate them entering into the openings and providing a fine adjustment to the rotational configuration of the table legs. The interconnection of the pins 145 in the openings 125 provides additional stability to the table legs when the table is in use. However, the pins 145 are not secured in the openings 125 of the locking ring 115 when the table legs are secured in a storage configuration. Located between the first sidewall 105 and the circular collar 140 is a spring 150 that acts to bias the circular collar 140 towards the locking ring 115. While the illustrated example shows a refined compact rotation mechanism, it should be appreciated that the spring 150 may be located distant from the remainder of the rotation mechanism. Highlighted in FIG. 11, the illustrated first sidewall 105 and the second sidewall 110 are asymmetric relative to the axis of rotation 130 of the table leg. Each of the sidewalls (105, 110) has a long edge 155 extending from the horizontal portion 55 of the table leg to the base 100, and a short edge 160 extending from the table leg to the base 100. The asymmetrical shape of the sidewalls allows for the horizontal portion 55 of the table leg to be positioned closer to the edge of the table top. The overlapping nature of the table legs allows for substantially longer table legs to be utilized than would otherwise be feasible. By positioning the horizontal portions of the table legs closer to the edge of the table top, the stability of the table while in a use configuration is increased.

Figure 16:
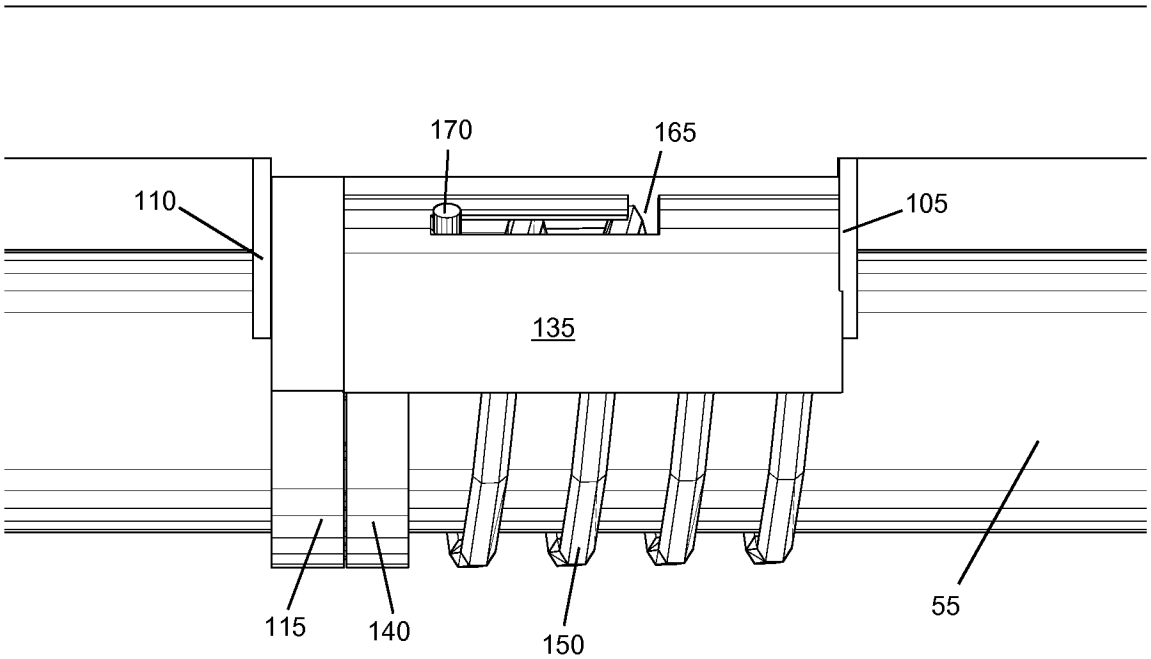
FIG. 16 is a side view of a folding mechanism secured in a use configuration.
Figure 17:
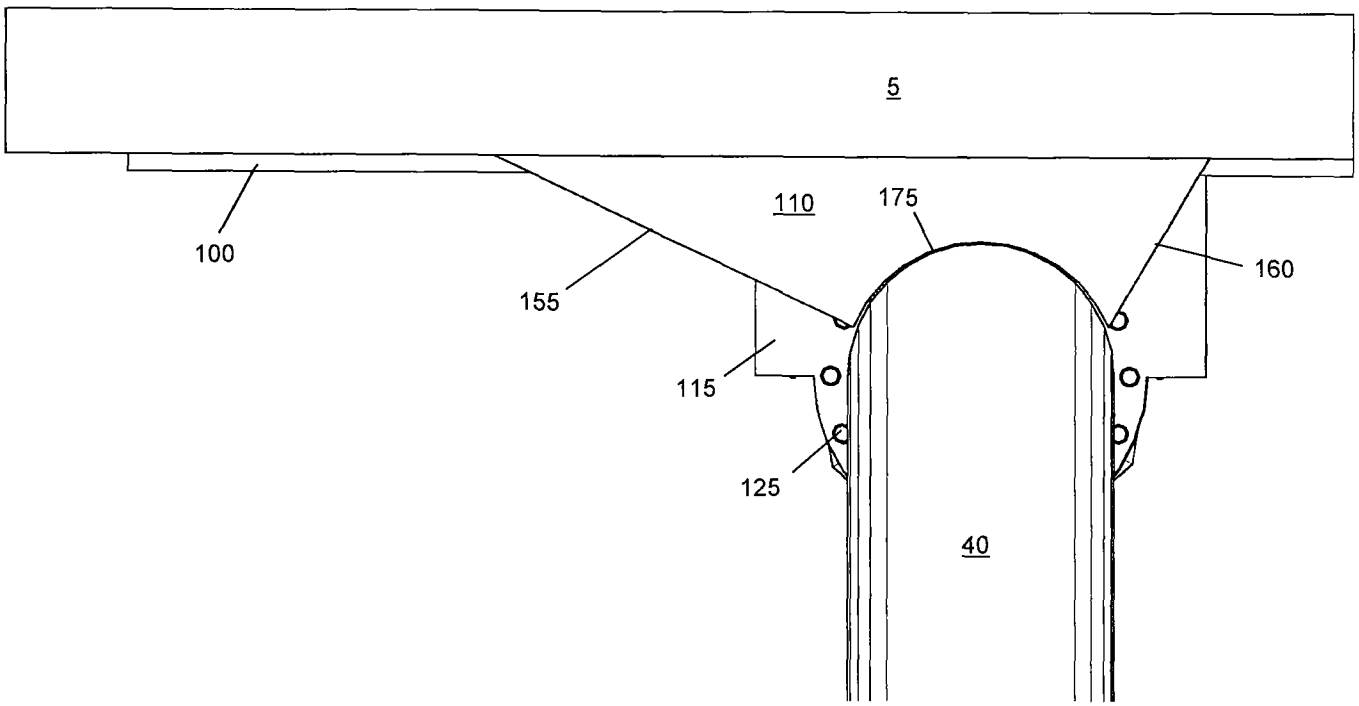
FIG. 17 is a second side view of a folding mechanism secured in a use configuration.

FIGS. 14 through 17 illustrate the rotation mechanism 15 where the circular collar 140 is pressed against the locking ring 115 such that the pins 145 are secured within the openings 125. The spring 150 continues to press the circular collar 140 towards the locking ring 115 to prevent the table legs from accidentally disengaging from the use configuration. FIG. 16 is a side view of the rotation mechanism that shows the cylindrical sheet 135 with a track 165 that surrounds a protrusion 170 of the horizontal portion 55 of the table leg that is radially aligned to the axis of rotation of the table leg. FIG. 17 highlights the profile of the second sidewall 110 that has a concave surface 175 between the long edge 155 and the short edge 160. The concave surface 175 is substantially defined by the circumference of the table leg, and may act to further secure the table leg to the table top 5. The first sidewall 105 also includes a similar concave surface that is defined by the circumference of the horizontal portion of the table leg.

Figure 18:
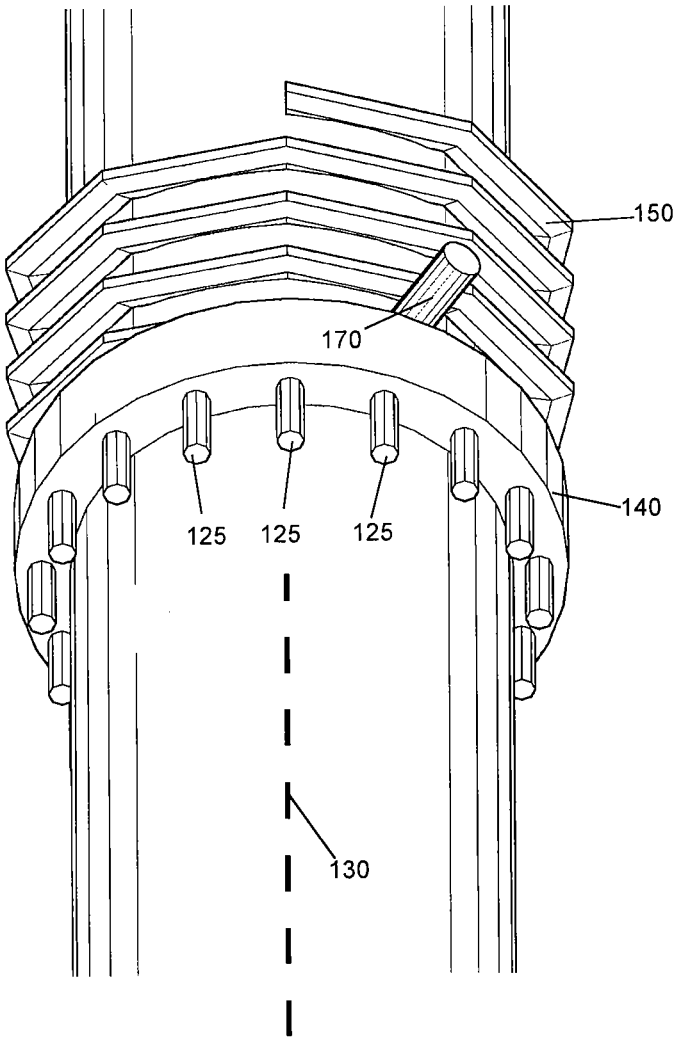
FIG. 18 is a perspective view of a table leg highlighting the protrusion between the spring and the ring of pins.
Figure 19:
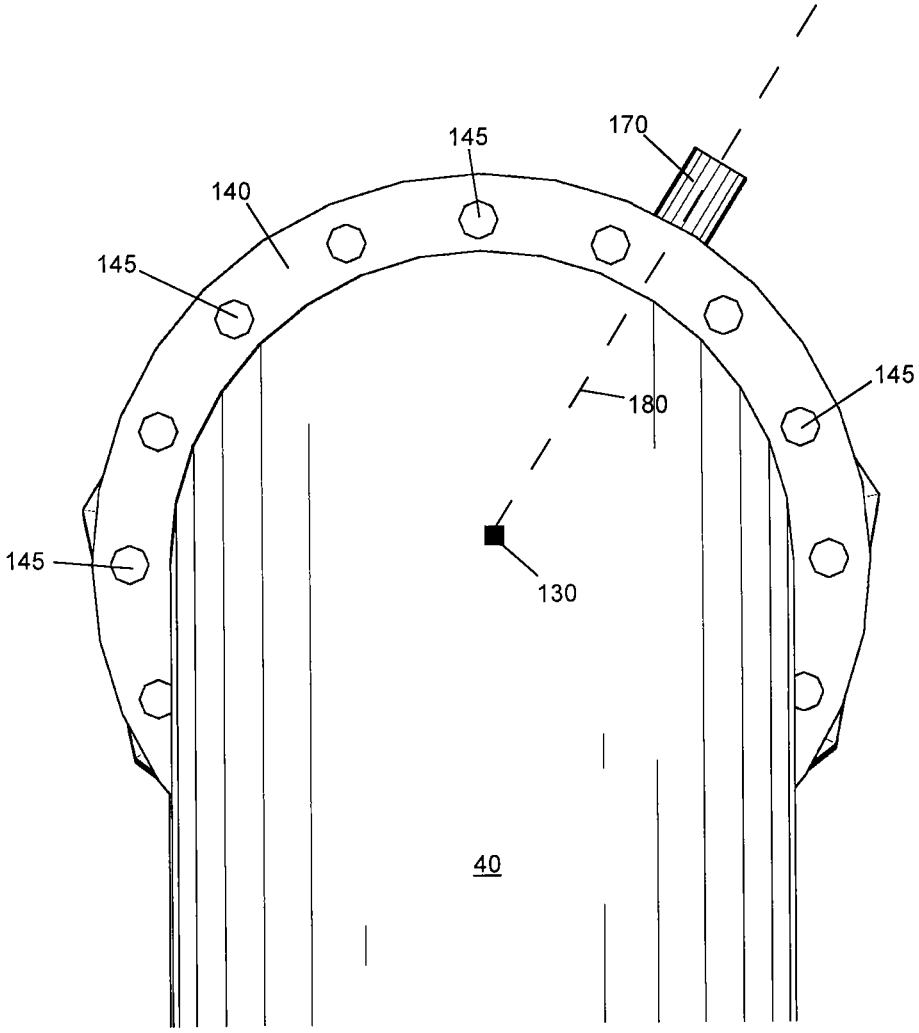
FIG. 19 is a side view of a table leg showing the protrusion and the ring of pins.
Figure 20:
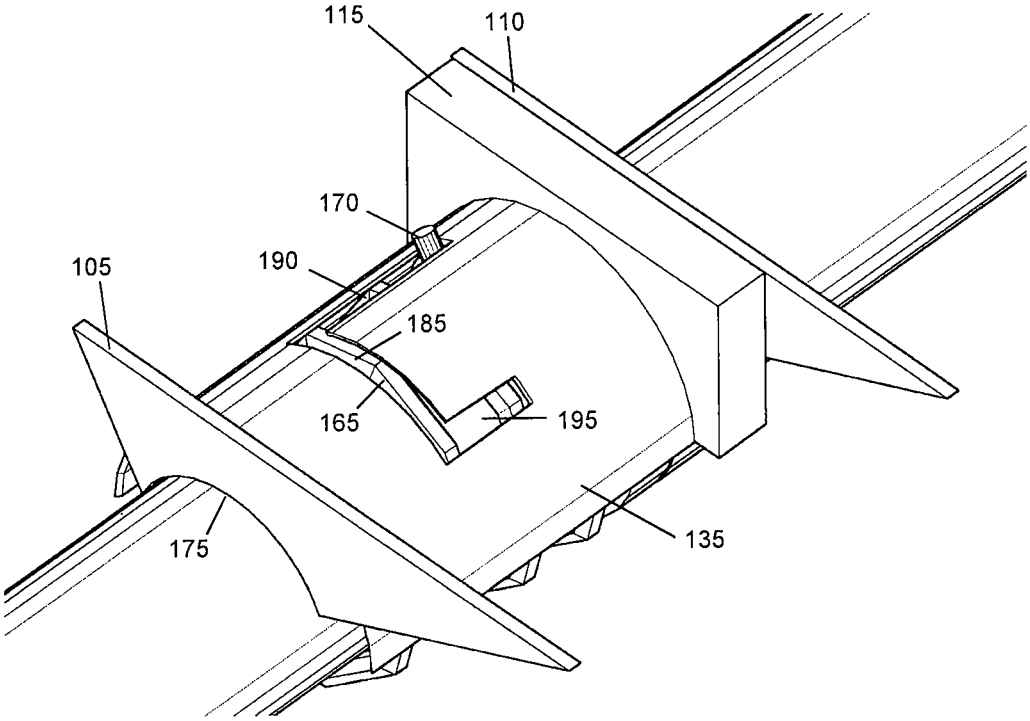
FIG. 20 is an upper perspective view of a rotation mechanism with the top portion of the rotation mechanism removed.
Figure 21:
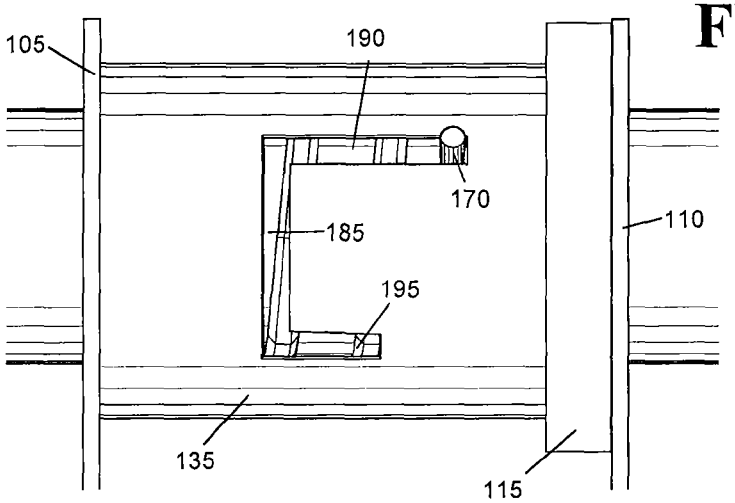
FIG. 21 shows a top view of a rotation mechanism with a table leg locked in a use configuration.
Figure 22:
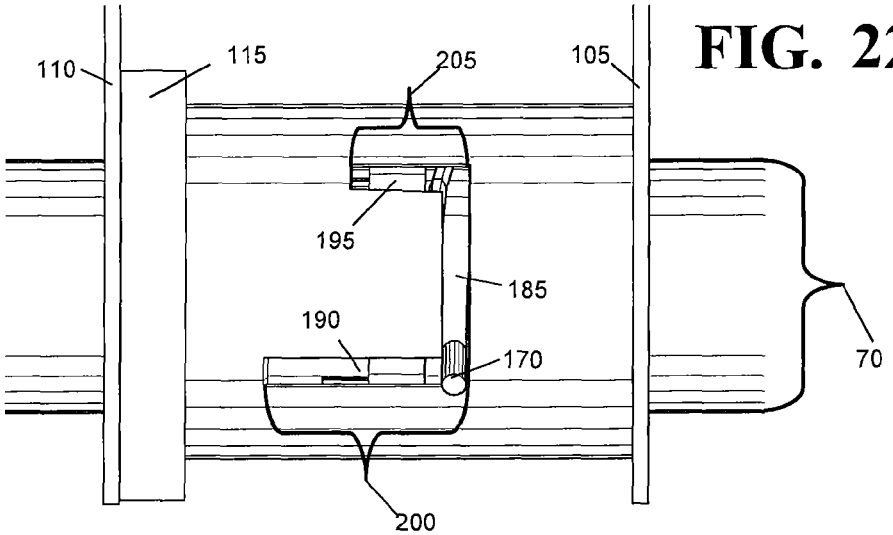
FIG. 22 shows a top view of a rotation mechanism with a table leg offset from the use configuration.

FIGS. 18 and 19 show a portion of the table leg and spring in isolation. The circular collar 140 fully circumscribes the horizontal portion of the table leg. The spring 150 is located near the circular collar 140 and the protrusion 170 is located between the spring 150 and the circular collar 140. While the protrusion 170 is located between the collar and spring in FIG. 18, it should be noted that the protrusion 170 extends directly from the circular collar 140 in FIG. 19. The protrusion 170 is aligned along a radius 180 of the axis of rotation 130 such that the protrusion has a length that is defined by a line extending perpendicularly from the axis of rotation 130.

FIGS. 20 through 23 highlight the track 165 in the cylindrical sheet 135 of the rotation mechanism. The base 100 of the rotation mechanism 15 has been removed to better illustrate the cylindrical sheet 135. The track 165 of the cylindrical sheet 135 includes a cylindrical portion 185 that rotationally extends along a geometric arc with the axis of rotation 130 as the center point. From the cylindrical portion 185 of the track 165 a first linear portion 190 extends perpendicularly away from the cylindrical portion 185 parallel to the axis of rotation 130 of the table leg. A second linear portion 195 also perpendicularly extends away from the cylindrical portion 185 distant from the first linear portion 190. The first linear portion 190 extends a first distance 200 while the second linear portion only extends a second distance 205. The difference between the first distance 200 and the second distance 205 is approximately one half of the width 70 of the table leg such that when the table legs are in a storage configuration they are kept in close proximity to each other. When the table legs are in the use configuration, the protrusion 170 is at the end of the first linear portion 190 of the track 165 that is closest to the locking ring 115 while when the table legs are in the storage configuration the protrusion 170 is located at the end of the second linear portion 195 that is closest to the locking ring 115. The spring in the rotation mechanism acts to bias the protrusion 170 towards the locking ring 115 (locking wall). To change the legs from a use configuration to a storage configuration (or vice versa), the legs are moved against the spring until the protrusion 170 is able to enter the cylindrical portion 185 of the track 165. Only once the protrusion has reached the cylindrical portion 185 of the track 165 are the table legs able to be rotated. The legs are then rotated until the protrusion reaches the opposite linear portion of the track at which point further rotation of the leg is not possible. Once at the opposite linear portion, the spring biases the protrusion 170 towards the locking ring 115 and the linear portion prevents rotation of the table leg. If the table legs are in the use configuration, the pins of the circular collar and the openings in the locking ring also act to prevent rotation of the table legs.

Figure 23:
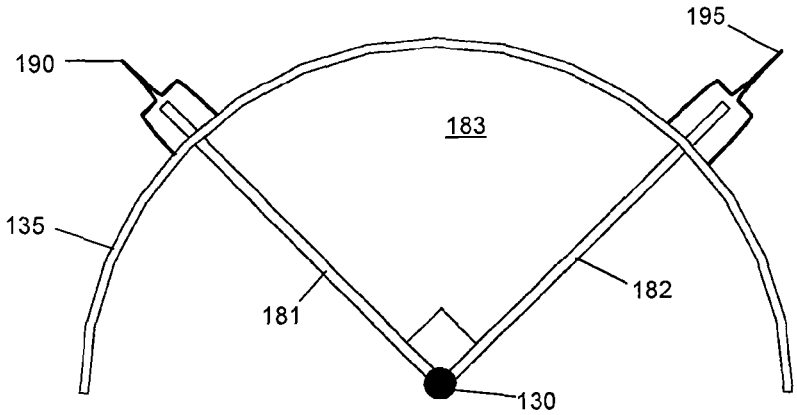
FIG. 23 shows an isolated side view of the cylindrical sheet.
Figure 24:
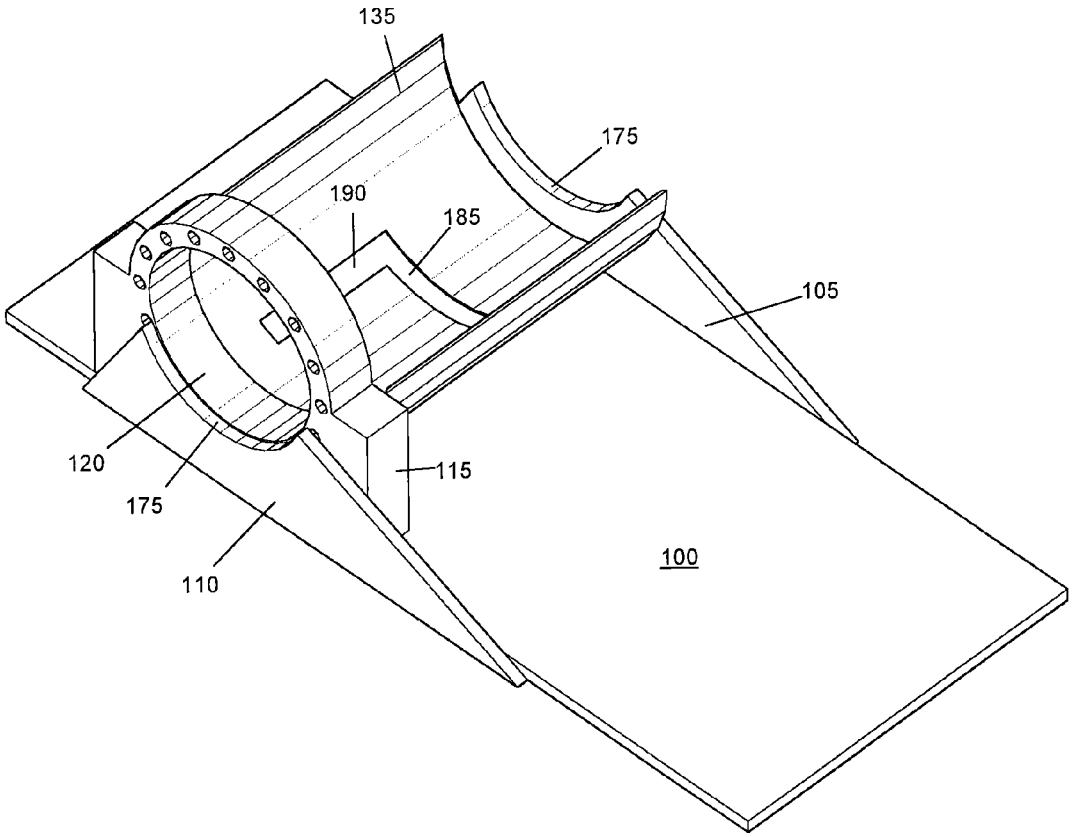
FIG. 24 is a perspective view of a rotation mechanism isolated from a table leg.
Figure 25:
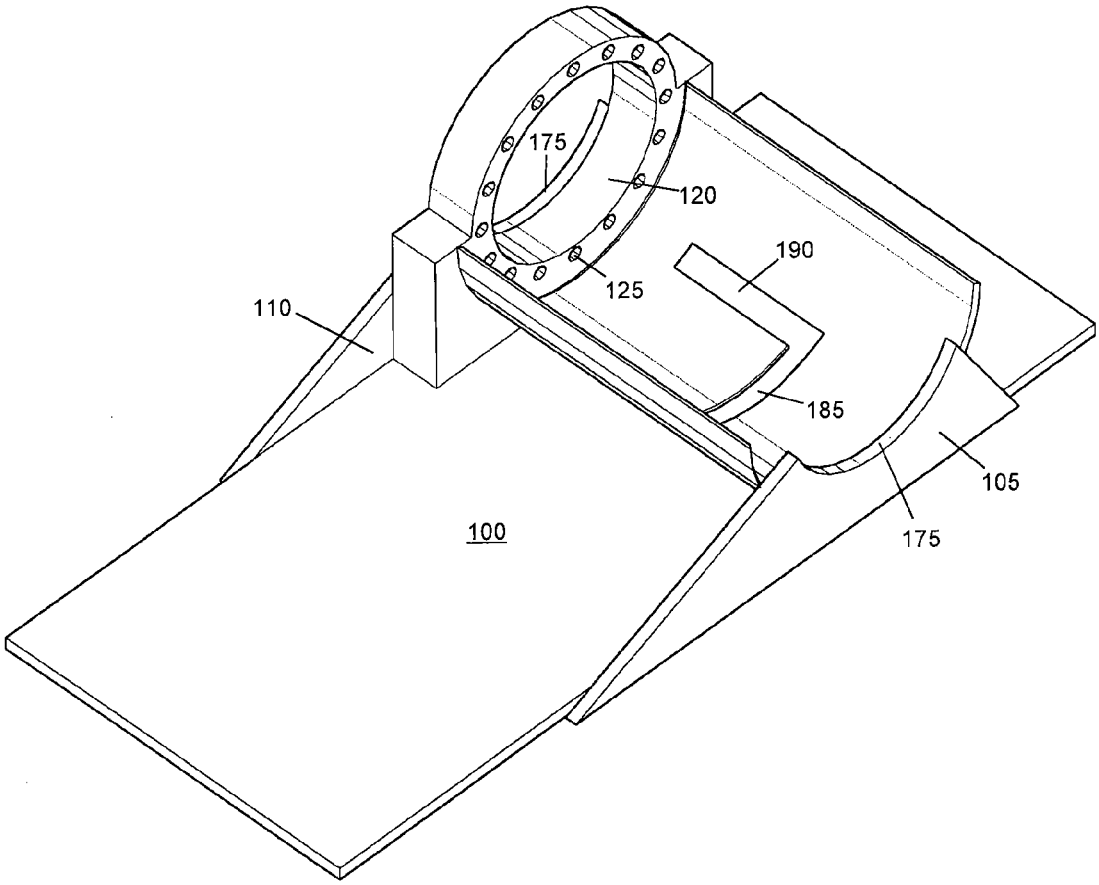
FIG. 25 is a second perspective view of a rotation mechanism isolated from a table leg.
Figure 26:
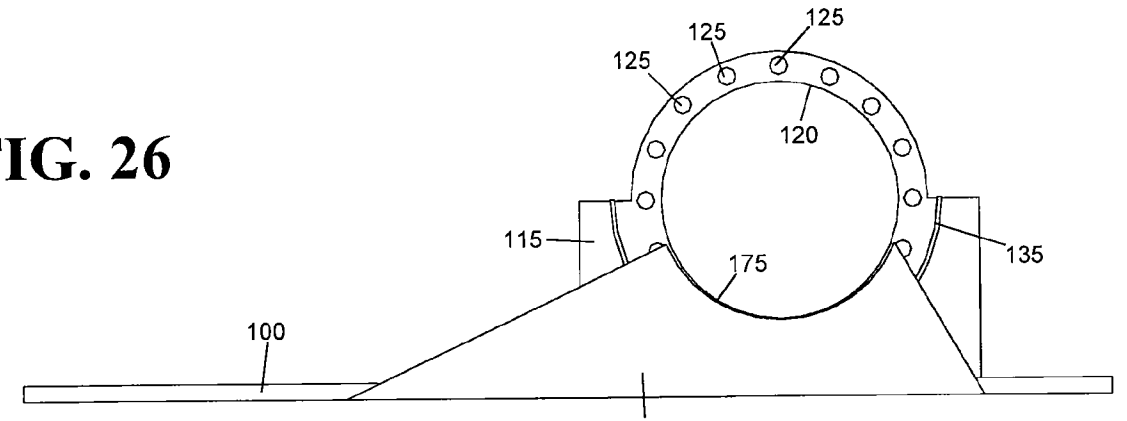
FIG. 26 is a side view of a rotation mechanism isolated from a table leg.
Figure 27:
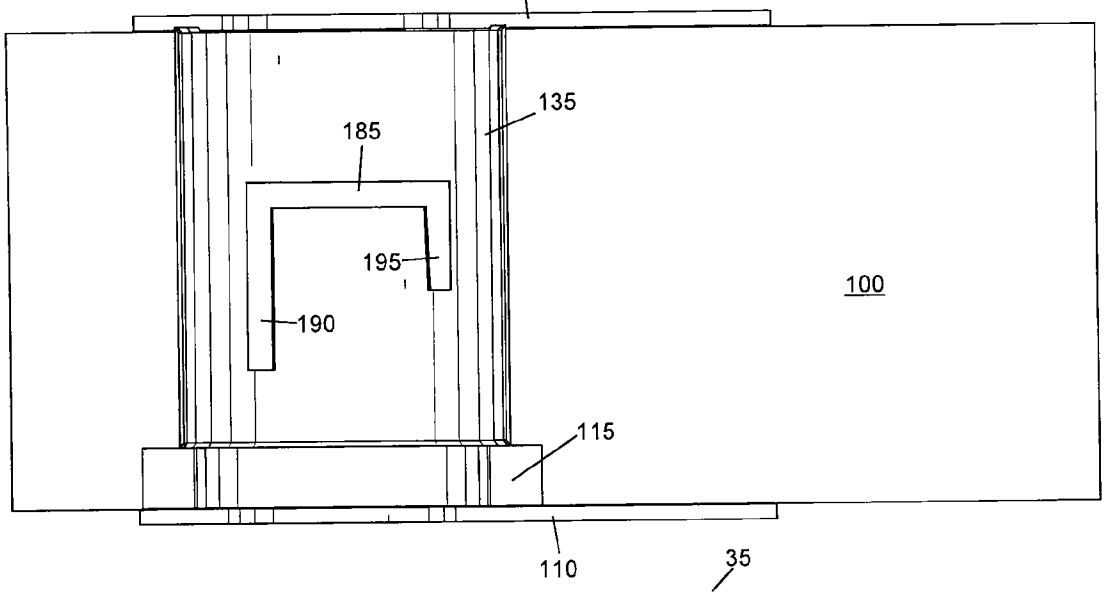
FIG. 27 is a bottom view of a rotation mechanism isolated from a table leg.

FIG. 23 shows a side view of the cylindrical sheet 135. A first geometric radius 181 and a second geometric radius 182 perpendicularly extend from the axis of rotation 130 through the centers of the first linear portion 190 and the second linear portion 195, respectively. The first and second geometric radiuses (181, 182) are at a right angle to each other such that one quadrant 183 about the axis of rotation 130 is defined by the two radiuses. The cylindrical portion 185 of the track 165 fully spans the quadrant 183 defined by the two radiuses. By spanning a single quadrant, the cylindrical portion 185 of the track 165 allows the table legs to be rotated 90 degrees, and no more.

FIGS. 24 through 27 show an isolated view of the rotation mechanism 15 without the horizontal portion of the table leg or the spring. Without the table leg, the circular aperture 120 of the locking ring 115 is shown having a diameter that is substantially similar to the concave surface 175 of the second sidewall 110. The first sidewall 105 also has a concave surface that is substantially similar to the circular aperture 120 of the locking ring 115. The illustrated cylindrical sheet 135 is shown having a half circular shape, however it should be appreciated that in an alternate embodiment the cylindrical sheet fully encloses a portion of the horizontal portion of the table leg. In another embodiment, the cylindrical sheet is less than half a circle in circumference, and in yet another embodiment, the cylindrical sheet has a circumference that is only slightly larger than the cylindrical portion of the track. In FIGS. 24-27, the base 100 is shown as being asymmetrical about the cylindrical sheet 135, however in another embodiment the base 100 is symmetrical. Additionally, the base 100 may be composed of several components that act to secure the rotation mechanism to the table top.

Figure 28:
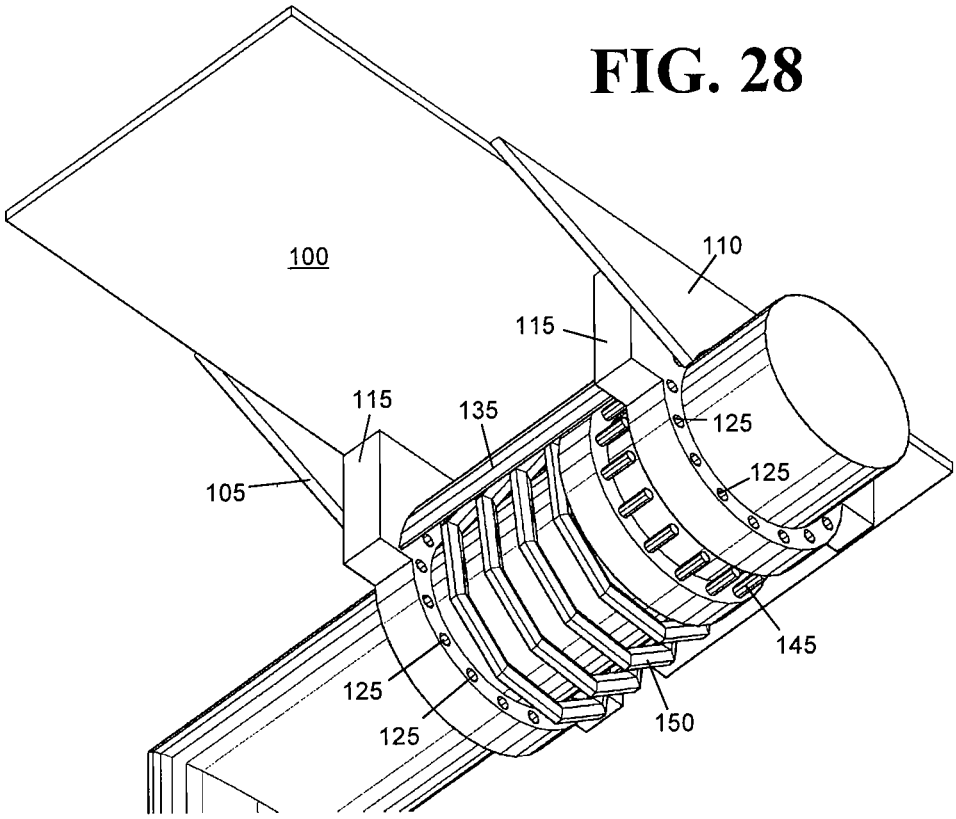
FIG. 28 is a bottom perspective view of a rotation mechanism adapted to secure a table leg with a single vertical portion.
Figure 29:
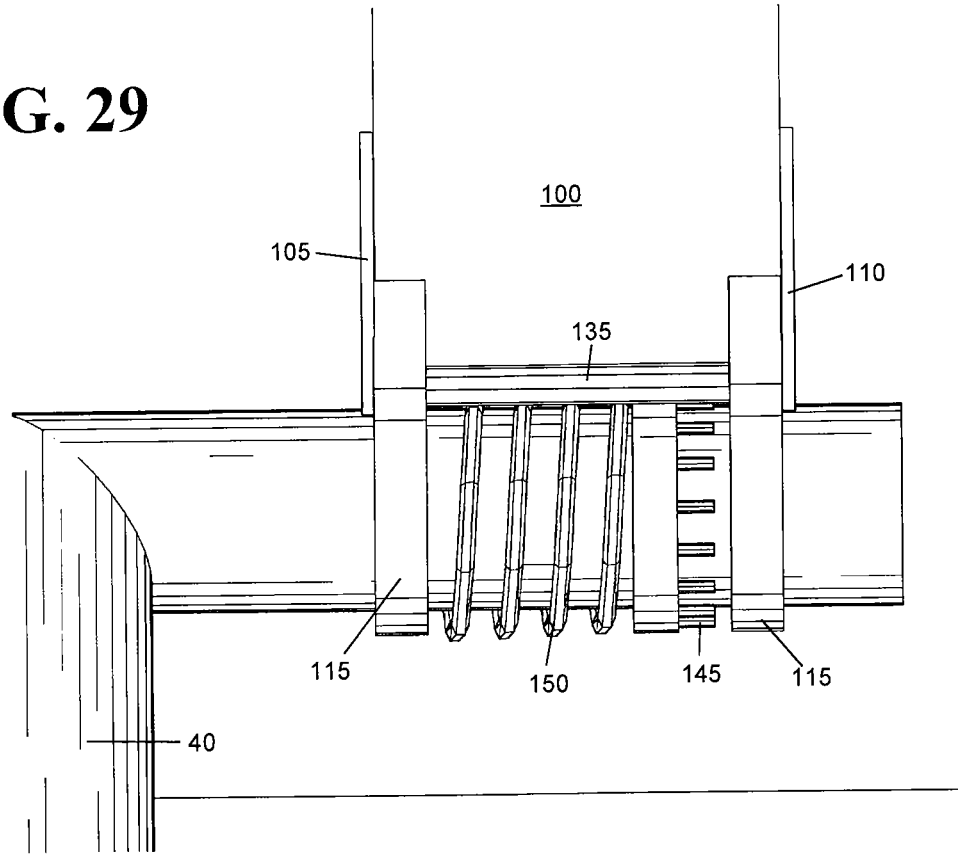
FIG. 29 is a bottom view of a rotation mechanism adapted to secure a table leg with a single vertical portion.

FIGS. 28 and 29 show an alternate embodiment of a rotation mechanism adapted to secure a table leg with a single vertical portion. The rotation mechanism shown in FIGS. 28 and 29 has all the components of the rotation mechanism shown in FIGS. 1 through 27 with the addition of a second locking ring 115 located adjacent to the first sidewall 105. The second locking ring acts primarily as a guide surface for the horizontal portion of the table leg and prevents wobble of the leg. To reduce wobble, the first and second locking rings are preferably spaced as far from each other as possible. As shown in FIG. 28, the first and second locking rings 115 include openings 125. The openings 125 of the second locking ring do not interact with the pins 145 of the table leg and may be omitted. However, to reduce the variety of pieces that need to be manufactured, it is expected that at in at least some embodiments all of the locking rings will be created with openings 145. In the illustrated example, the locking rings 115 are identical to each other and provide the rotation mechanism with a refined appearance; however, it should be appreciated that in other embodiments the two locking rings may have substantially different shapes from each other.

Figure 30:
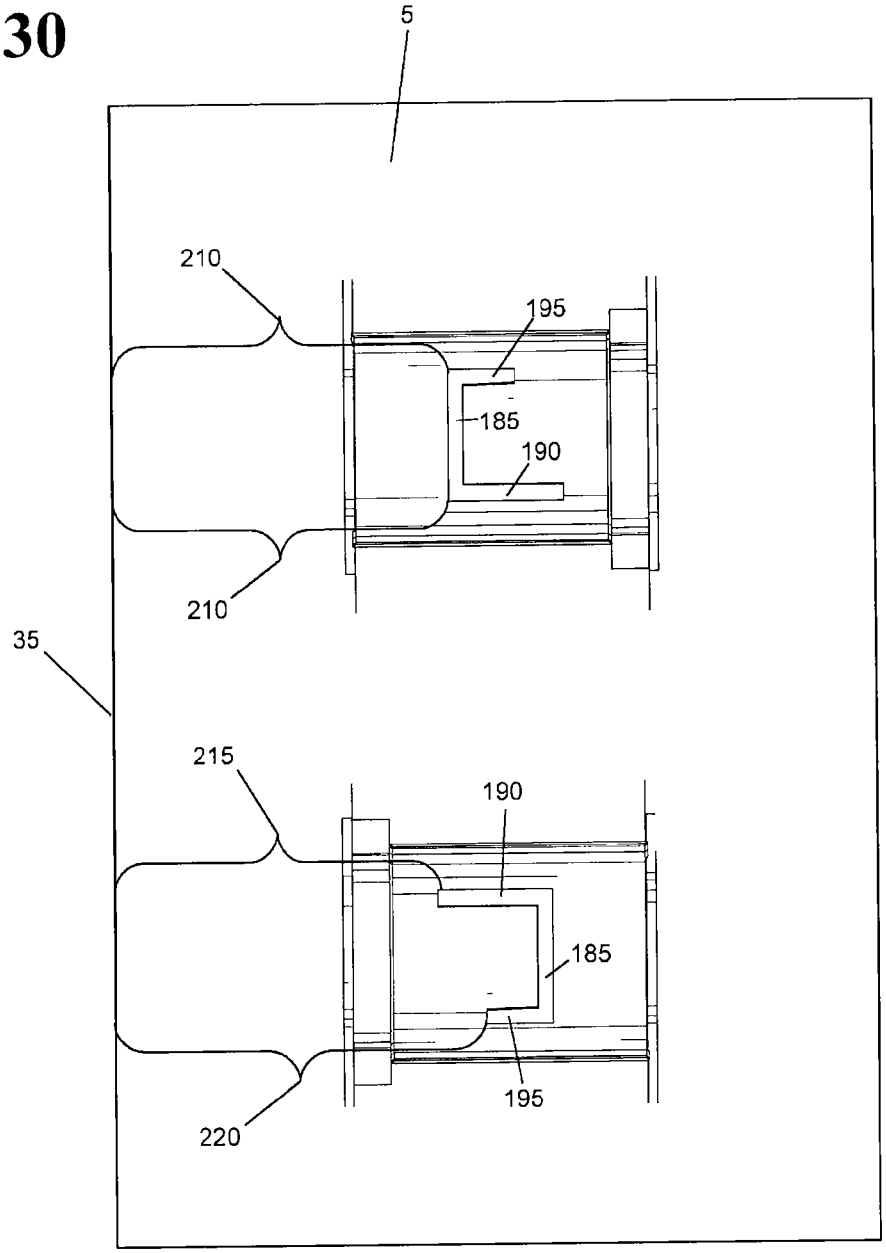
FIG. 30 is schematic view of a table top with rotation mechanisms.

FIG. 30 shows a schematic view of two rotation mechanism secured to a table top 5. The table top has a first linear horizontal edge 35, and the rotation mechanisms each have cylindrical sheets 135 with tracks having cylindrical portions 185, first linear portions 190, and second linear portions 195. In mechanism show in the upper portion of the figure, the first linear portion 190 and the second linear portion 195 are both a first length 210 from the linear horizontal edge 35. They are equidistant from the edge. In comparison, the first linear portion 190 of the lower rotation mechanism is a second length 215 from the linear horizontal edge 35 while the second linear portion 195 is a third length 220 from the edge. The third length is substantially greater than the second length. In the upper rotation mechanism, a spring would bias the protrusion away from the linear horizontal edge 35, while the lower mechanism would have a spring biasing another protrusion on the table leg towards the linear horizontal edge 35.

The inventors contemplate several alterations and improvements to the disclosed invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the apparatus described.

I claim:

1. A table system comprising:

a table top connecting to a table leg though a rotation mechanism, the table leg rotatable about an axis of rotation having a horizontal portion adjacent to the table, a protrusion secured to the horizontal portion and radially extending away from the axis of rotation, and a first leg portion perpendicularly extending away from the horizontal portion;

the rotation mechanism with a first linear edge, a second linear edge, and a curved edge between the first linear edge and the second linear edge, the rotation mechanism rigidly secured to the table top, and the rotation mechanism including a track surrounding the protrusion, the track having a cylindrical portion partially circumscribing the horizontal portion of the table leg and bounded by the curved edge, a first linear portion perpendicularly extending from the cylindrical portion and bounded by the first linear edge, and a second linear portion perpendicularly extending from the cylindrical portion bounded by the second linear edge, and located distant from the first linear portion.

2. The table system of claim 1 wherein the table leg is rotatable from a storage position wherein the first leg portion is adjacent to the table top to a use position wherein the first leg portion extends away from the table top;

wherein the protrusion is located within the first linear portion of the track in the storage position, located within the second linear portion of the track in the use position.

3. The table system of claim 2 wherein the table top includes a side edge;

the rotation mechanism further includes a third edge located a first distance from the side edge of the table top, extending away from first edge, and bounding the first linear portion of the track of the rotation mechanism, a fourth edge located a second distance from the side edge of the table top, extending away from second edge, and bounding the second linear portion of the track of the rotation mechanism, the protrusion is located adjacent to the third edge in the storage position, the protrusion is located adjacent to the fourth edge in the use position, and the first distance is substantially different from the second distance.

4. The table system of claim 3 wherein the first leg portion has a first width, and the difference of the first distance and the second distance is half the first width.

5. The table system of claim 2 wherein the table leg includes a plurality of pins rigidly secured to and circumscribing the horizontal portion, and directly contacting the rotation mechanism when the table leg is in both the use position and the storage position.

6. The table system of claim 5 further comprising a spring connecting to both the table leg and the rotation mechanism to bias the plurality of pins into a plurality of holes in the rotation mechanism.

7. The table system of claim 1 wherein the table leg includes a second leg portion perpendicularly extending away from the horizontal portion, parallel to the first leg portion, and distant from the first leg portion.

8. The table system of claim 1 wherein the cylindrical portion of the track circumscribes geometric quadrant about the axis of rotation.

9. The table system of claim 1 wherein the rotation mechanism includes a plate directly contacting the table top, a cylindrical piece mounted on the plate and including the track, and a first wall rigidly secured to the plate and extending away from the table top, the horizontal portion of the table leg passing through an aperture in the first wall.

10. The table system of claim 9 wherein the first linear portion and the second linear portion are both located directly between the cylindrical portion and the first wall, and a spring connecting to the table leg and rotation mechanism to force the protrusion towards the first wall.

11. The table system of claim 10 wherein the rotation mechanism includes a second wall rigidly secured to the plate and extending away from the table top parallel to the first wall, a third wall adjacent to the first wall, the cylindrical piece is flanked by the third wall and the second wall, and the spring is located between the first wall and the second wall.

12. A table system comprising a table top with a linear horizontal edge;

a first table leg and a second table leg, each table being rotationally secured to the table top through a rotation mechanism, rotatable about an axis of rotation between a storage configuration and a use configuration, located adjacent to the table to in the storage configuration, and extending away from the table top in the use configuration;

in the storage configuration both the first table leg and the second table leg both located near the linear horizontal edge, the first table leg located a first distance from the linear horizontal edge, the second table leg located a second distance from the linear horizontal edge, wherein the second distance is greater than the first distance;

in the use configuration the first table leg and the second table leg are equidistant from the linear horizontal edge;

wherein each table leg includes a protrusion radially extending away from the axis of rotation of the table leg, the rotation mechanism of each table leg includes an arcuate edge between a first linear edge and a second linear edge, a track for guiding the protrusion of the table leg, the track having a cylindrical portion with a first end and a second end, the cylindrical portion extending perpendicular to the axis of rotation of the table leg, the cylindrical portion bounded by the arcuate edge, a first linear portion bounded by the first linear edge extending from the first end perpendicular to the cylindrical portion and parallel to the axis of rotation, a second linear portion bounded by the second linear edge and located distant from the first linear portion and
extending
from the second end
perpendicular to the cylindrical portion and parallel to the axis of rotation;

wherein
the first linear portion
of the rotation mechanism
of the first table leg, and
the second linear portion
of the rotation mechanism
of the first table leg
are equidistant from the first linear horizontal edge, and wherein
the first linear portion
of the rotation mechanism
of the second table leg
is a third distance from the first linear horizontal edge,
the second linear portion
of the rotation mechanism
of the second table leg
is a fourth distance from the first linear horizontal edge, and
the fourth distance is substantially greater than the third distance.

13. The table system of claim 12 further comprising a first spring connecting to both the first table leg and the rotation mechanism of the first table leg to bias the protrusion of the first table leg away from the linear horizontal edge, and a second spring connecting to both the second table leg and the rotation mechanism of the second table leg to bias the protrusion of the second table leg towards the linear horizontal edge.

14. The table system of claim 12 wherein the first linear portions of the rotation mechanisms of both the first and second table legs have a first length;

the second linear portions of the rotation mechanisms of both the first and second table legs have a second length; and the difference of the first length and the second length is half the width of the first table leg.

15. A table system comprising a table top with a linear horizontal edge;

a first table leg and a second table leg, each table being
rotationally secured to the table top through a rotation mechanism,
rotatable about an axis of rotation between a storage configuration and a use configuration,
located adjacent to the table to in the storage configuration and
extending away from the table top in the use configuration;

in the storage configuration
both the first table leg and the second table leg both located near the linear horizontal edge,
the first table leg located a first distance from the linear horizontal edge,
the second table leg located a second distance from the linear horizontal edge,
wherein the second distance is greater than the first distance;

in the use configuration
the first table leg and the second table leg are equidistant from the linear horizontal edge;

each table leg includes
a projection radially extending away from the axis of rotation, and
a rotation linkage distant from the rotation mechanism of the table leg,
the rotation linkage includes
a cylindrical edge between a first edge and a second edge, and
a track for guiding the projection of the table leg, the track having
a cylindrical portion with a first end and a second end, the cylindrical portion bounded by the cylindrical edge of the rotation linkage and extending perpendicular to the axis of rotation of the table leg,
a first linear portion bounded by the first edge of the rotation linkage and
extending
from the first end
perpendicular to the cylindrical portion and parallel to the axis of rotation,
a second linear portion
bounded by the second edge of the rotation linkage,
located distant from the first linear portion, and
extending
from the second end
perpendicular to the cylindrical portion and parallel to the axis of rotation.

16. The table system of claim 15 wherein the rotation mechanism of the first table leg includes
a ring of holes circumscribing and extending parallel to the axis of the first table leg, the first table leg includes a ring of pegs circumscribing and extending parallel to the axis of rotation of the first table leg, and wherein the use configuration the ring of pegs are located within the ring of holes.

17. The table system of claim 15 wherein the table top has a table length;

each table leg includes a horizontal portion aligned with the axis of rotation of the table leg and passing through the rotation mechanism of the table leg a first leg portion distant from a second leg portion, each leg portion extending perpendicularly from the horizontal portion and having a length greater than one half of the table length.

* * * * *